US012799714B2

(12) United States Patent
Young

(10) Patent No.: US 12,799,714 B2
(45) Date of Patent: Nov. 17, 2026

(54) HIGH VOLTAGE INTERLOCK LOOP FOR ELECTRIC IMPLEMENTS OF POWER MACHINES

(71) Applicant: Doosan Bobcat North America, Inc., West Fargo, ND (US)

(72) Inventor: Christopher Young, Fargo, ND (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 137 days.

(21) Appl. No.: 18/660,497

(22) Filed: May 10, 2024

(65) Prior Publication Data

US 2024/0376690 A1 Nov. 14, 2024

Related U.S. Application Data

(60) Provisional application No. 63/501,185, filed on May 10, 2023.

(51) Int. Cl.
*E02F 9/20* (2006.01)
*E02F 9/26* (2006.01)

(52) U.S. Cl.
CPC ..... *E02F 9/2095* (2013.01); *E02F 9/267* (2013.01)

(58) Field of Classification Search
CPC ..... E02F 9/2095; E02F 9/267; B60L 1/003; B60L 3/0023; B60L 2200/40
See application file for complete search history.

(56) References Cited

U.S. PATENT DOCUMENTS

2019/0057295 A1* 2/2019 Koekemoer ..... G06K 19/07773
2019/0128948 A1 5/2019 Smith et al.
2021/0229591 A1* 7/2021 Dannar ..... B60P 3/42
2021/0270004 A1 9/2021 Durkin et al.
2022/0024318 A1* 1/2022 Baumann ..... B60L 53/20

FOREIGN PATENT DOCUMENTS

CN 110058180 A 7/2019
CN 111650541 A 9/2020
KR 20220026094 A * 3/2022 ..... G01R 31/385

OTHER PUBLICATIONS

English translation of Jeong et al. (KR 20220026094) (Year: 2022).*
International Searching Authority, International Search Report and Written Opinion issued for corresponding International Application No. PCT/US2024/028738 mailed Sep. 18, 2024 [13 pgs.].

* cited by examiner

*Primary Examiner* — Kyle J Kingsland
(74) *Attorney, Agent, or Firm* — Quarles & Brady LLP

(57) ABSTRACT

Power management and diagnostics systems are provided for power machines. One system includes an electronic processor that provides output signals to an electric circuit of an electric implement removably coupled to a power machine and receives corresponding return signals. Based on the return signal, the electronic processor may determine a connection status associated with a high-voltage connection between the electric implement and the power machine. The electronic processor may control a power source of the power machine based on the connection status.

16 Claims, 12 Drawing Sheets

HIGH VOLTAGE INTERLOCK LOOP FOR ELECTRIC IMPLEMENTS OF POWER MACHINES

CROSS-REFERENCE TO RELATED APPLICATIONS

This application claims the benefit of and priority to U.S. Provisional Application No. 63/501,185, filed May 10, 2023, the entirety of which is incorporated by reference herein.

BACKGROUND

This disclosure is directed toward power machines. More particularly, the present disclosure is directed to power machines that operate in whole or in part under electrical power. Power machines, for the purposes of this disclosure, include any type of machine that generates power for the purpose of accomplishing a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

The discussion above is merely provided for general background information and is not intended to be used as an aid in determining the scope of the claimed subject matter.

SUMMARY OF THE DISCLOSURE

Examples of the technology disclosed herein includes implementing a high voltage interlock look (HVIL) into an auxiliary (AUX) high-voltage electric connection on a power machine that supplies electrical power to an attachable implement. A HVIL may use a continuous, low-voltage loop that monitors one or more high-voltage connectors or components in an electrically powered power machine (or, simply, an electric power machine). In some configurations, when the HVIL detects an error, power may be disabled for the power machine or relevant sub-system thereof, an alert or error code may be triggered, an operating mode of the power machine may be initiated, etc.

Some configurations of the present disclosure provide a system. The system may include one or more electronic processors. The one or more electronic processors may be configured to generate and transmit an output signal to a first electric circuit of an electrically powered implement removably coupled to a power machine. The one or more electronic processors may be configured to receive a return signal from the first electric circuit, the return signal being provided by the first electric circuit in response to the output signal. The one or more electronic processors may be configured to determine, based on the return signal, a status of the electrically powered implement. The one or more electronic processors may be configured to control routing of power from an electrical power source of the power machine to the electrically powered implement based on the status.

Some configurations described herein provide a power machine. The power machine may include a frame. The power machine may include an electrical power source supported by the frame. The power machine may include an attachment assembly supported by the frame. The attachment assembly may include a connector assembly electrically coupling the attachment assembly to the power machine. The attachment assembly may include a first electrically powered implement removably supported by the frame, the first electrically powered implement configured to perform work operations using power from the electrical power source received via the connector assembly. The attachment assembly may include an electric network. The electric network may include a first electric circuit configured to receive and route a first output signal. The electric network may include a second electric circuit configured to receive power from the electrical power source to power an electric actuator of the first electrically powered implement. The power machine may include a control system electrically coupled to the attachment assembly via the connector assembly. The control system may include one or more electronic processors. The one or more electronic processors may be configured to generate and provide the first output signal to the first electric circuit via the connector assembly. The one or more electronic processors may be configured to receive a first return signal from the first electric circuit via the connector assembly, the first return signal corresponding to transmission of the first output signal through the first electric circuit. The one or more electronic processors may be configured to determine, based on the first return signal, a first status for the attachment assembly. The one or more electronic processors may be configured to control routing of power from the electrical power source to the second electric circuit via the connector assembly, based on the first status.

Some configurations described herein provide an attachment assembly for a power machine. The attachment assembly may include an attachment frame removably attachable to the power machine via an implement interface of the power machine. The attachment assembly may include a connector supported by the attachment frame, the connector configured to electrically couple the attachment assembly to the power machine. The attachment assembly may include an electric actuator supported by the attachment frame, the electric actuator configured to perform work operations. The attachment assembly may include an electric network supported by the attachment frame and electrically couplable to a power system of the power machine via the connector. The electric network may include a first electric circuit configured to receive an output signal and provide a return signal, based on the output signal, to indicate a connection status of the connector. The electric network may include a second electric circuit configured to receive power from the power system of the power machine via the connector and route the power to the electric actuator.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

The following drawings are provided to help illustrate various features of examples of the disclosure and are not intended to limit the scope of the disclosure or exclude alternative implementations.

DETAILED DESCRIPTION OF THE PRESENT DISCLOSURE

Figure 1:
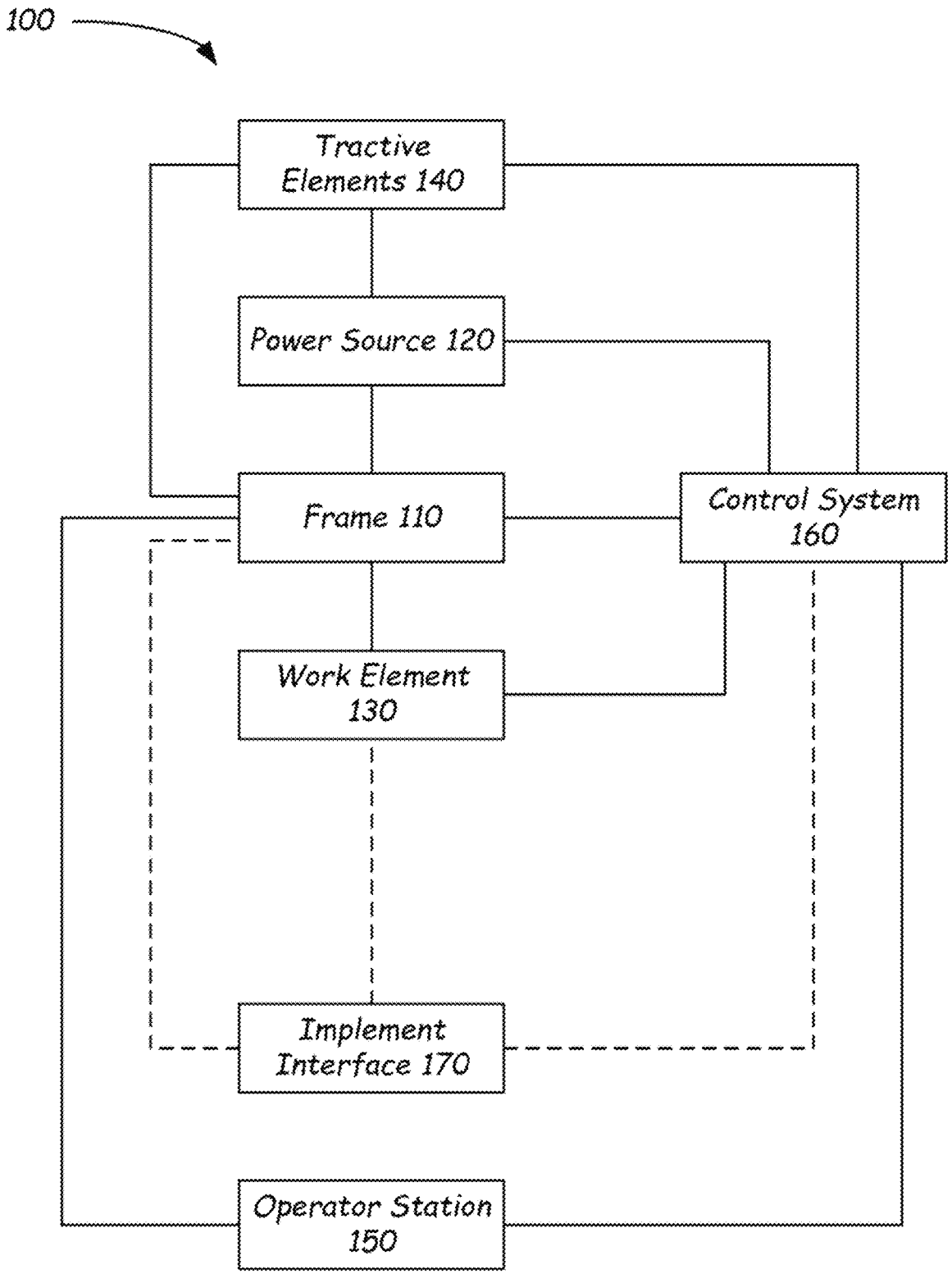
FIG. 1 is a block diagram illustrating functional systems of a representative power machine on which configurations of the present disclosure can be advantageously practiced.

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

While the power machines disclosed herein may be embodied in many different forms, several specific embodiments are discussed herein with the understanding that the embodiments described in the present disclosure are to be considered only exemplifications of the principles described herein, and the technology disclosed herein is not intended to be limited to the embodiments illustrated.

Some discussion below describes improved components and configurations for power machines, including components and configurations that use electric (e.g., as opposed to hydraulic) power to operate certain power machine components or otherwise implement certain power machine functionality. In some configurations, electrically powered components can be mounted to a frame of a power machine to selectively move work elements of the power machine, including, e.g., lift arms, implement carriers, etc. In some configurations, electrically powered components can provide motive power for a power machine, including for tracked power machines (e.g., compact tracked loaders).

The technology disclosed herein relates to electric power machines with attachable implements and, more particularly, to incorporating a high voltage interlock loop (HVIL) with respect to electrically powered attachable implements (or, simply, electric implements). Generally, an HVIL may send an alert or trouble code to an operator when a high-voltage connection becomes loose, disconnected, or damaged during the operation of the electric power machine or vehicle. In some implementations, as further discussed below, an HVIL system can act as a kind of circuit breaker that disconnects the attachable implement from a power source or automatically implements one or more other remedial actions upon detection of particular faults associated with the HVIL system.

A HVIL may use a low voltage signal on a continuous, low-voltage loop to monitor one or more high-voltage connectors or components in an electric power machine. When the low-voltage signal is interrupted for any reason, that interruption may indicate an issue with the high-voltage system that should be addressed. In some cases, when a fault condition is detected in an HVIL circuit, a diagnostic trouble code may be triggered, and an alert may appear on a control panel to, e.g., let operators know they should bring the power machine in for service. The trouble code may also provide information for service technicians on the nature or cause of the problem. In some cases, other actions may be taken, as further discussed below (e.g., automatic removal of power from an electric implement).

The technology disclosed herein includes implementing a HVIL into an AUX high-voltage electric connection on a power machine that supplies power to an attachable implement. In some configurations, the HVIL for the implement may be a separate low-voltage loop that extends from an HVIL controller and runs in the same bundle of wires as the high-voltage lines coupled to the electric implement.

At a high level, the HVIL may extend through an AUX (or other) electrical connector on an outside of the power machine and loop back (e.g., extending, when complete, through both mating electrical plugs, to return to an associated controller). Alternatively, or in addition, the HVIL may extend through an entire length of the implement wiring loom (e.g., from an HVIL controller through the two mating electric plugs on the power machine, to the one or more electrical connectors on the implement itself and back through the mating electrical plugs on the power machine to an input on the HVIL controller).

In some configurations, an error sensed by the HVIL may result in a control system disabling high-voltage power to the AUX electrical system (e.g., via implementation of zero-power protocols, including safe torque off protocols as further discussed below). Alternatively, or in addition, in some configurations, an error sensed by the HVIL may disable power to the power machine when, during operation, the HVIL controller suddenly loses signal through the HVIL.

Figure 2:
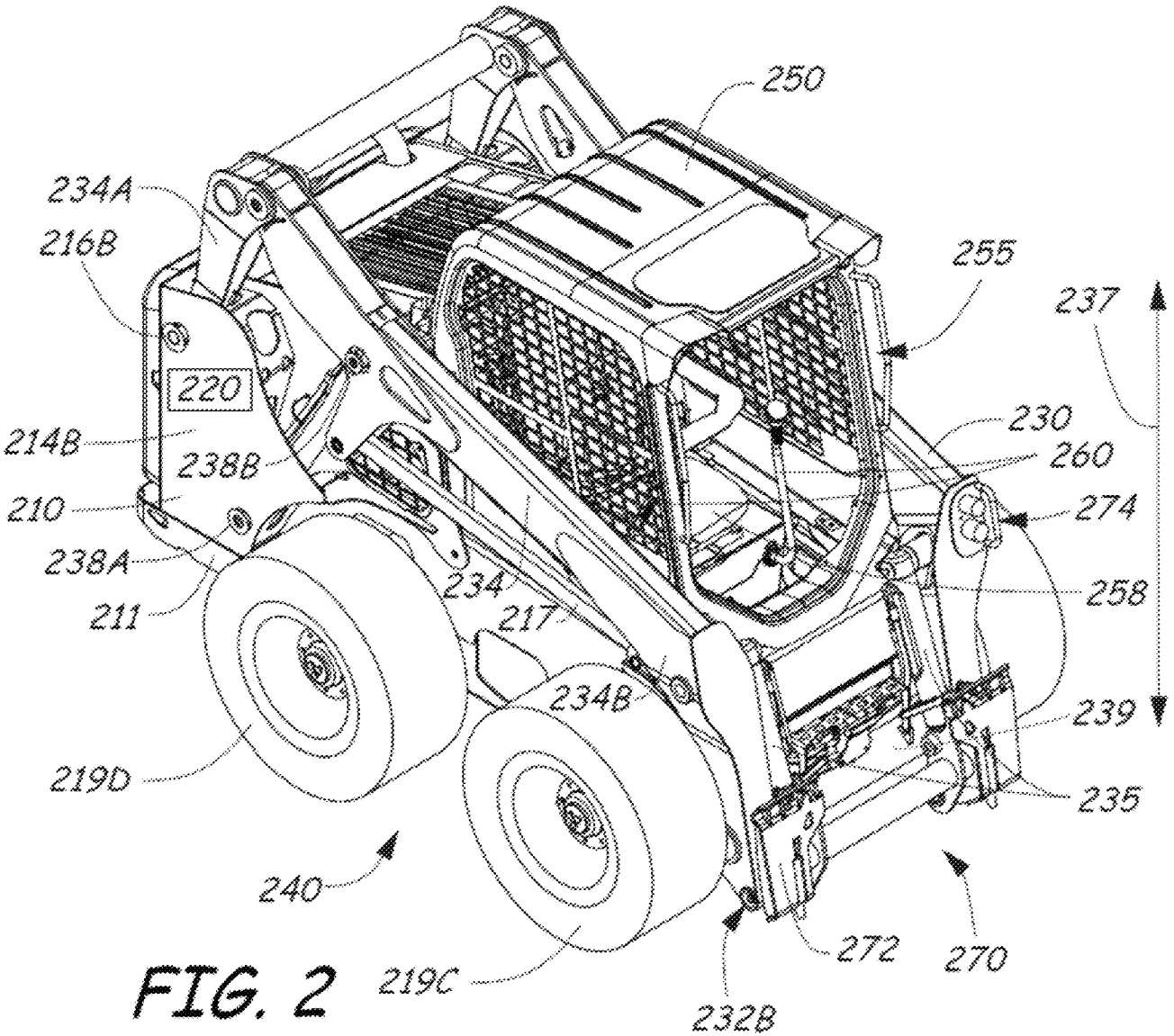
FIG. 2 is a perspective view showing generally a front of a power machine on which configurations disclosed in this specification can be advantageously practiced.
Figure 3:
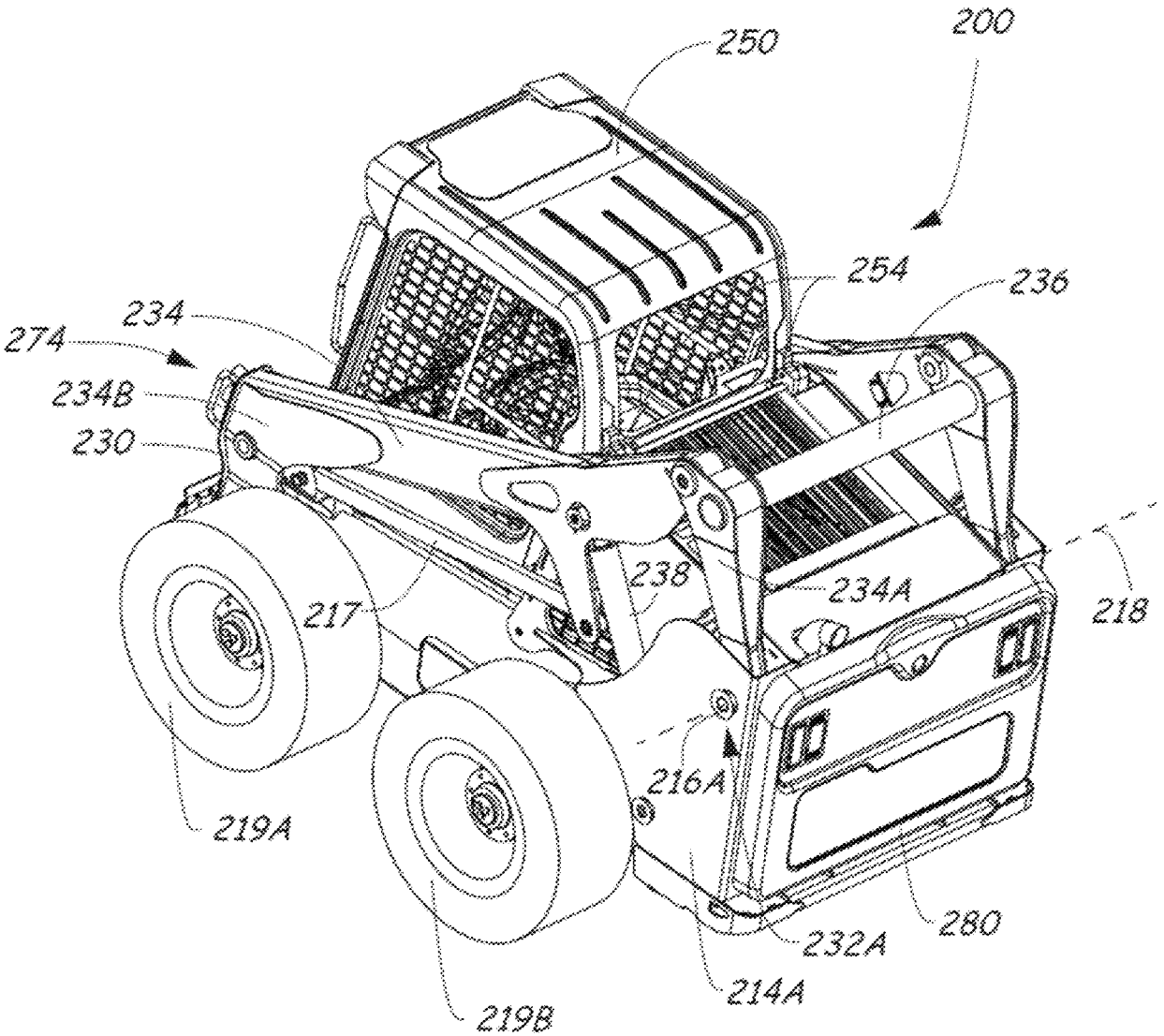
FIG. 3 is a perspective view showing generally a back of the power machine shown in FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is illustrated and discussed as being a representative power machine. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

FIG. 1 is a block diagram that illustrates the basic systems of a power machine 100, which can be any of a number of different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement to perform the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of different implements to the work element. One characteristic of such an implement carrier is that once an implement is attached to it, it is fixed to the implement (i.e., not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. For example, the power machine can be a mower with a mower deck or other mower component as a work element, which may be movable with respect to the frame of the mower. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e., from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e., remote from both of the power machine and any implement to which is it coupled) that is capable of controlling at least some of the operator-controlled functions on the power machine.

FIGS. 2-3 illustrate a loader 200, which is one particular example of a power machine of the type illustrated in FIG. 1 where the embodiments discussed below can be advantageously employed. Loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements. Correspondingly, although some example power machines discussed herein are presented as skid-steer power machines, some embodiments disclosed herein can be implemented on a variety of other power machines. For example, some embodiments can be implemented on compact loaders or compact excavators that do not accomplish turns via skidding.

Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. Skid-steer loader 200 is described herein to provide a reference for understanding one environment on which the embodiments described below related to track assemblies and mounting elements for mounting the track assemblies to a power machine may be practiced. The loader 200 should not be considered limiting especially as to the description of features that loader 200 may have described herein that are not essential to the disclosed embodiments and thus may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220, the power system being capable of generating or otherwise providing power for operating various functions on the power machine. Power system 220 is shown in block diagram form but is located within the frame 210. Frame 210 also supports a work element in the form of a lift arm assembly 230 that is powered by the power system 220 and that can perform various work tasks. As loader 200 is a work vehicle, frame 210 also supports a traction system 240, which is also powered by power system 220 and can propel the power machine over a support surface. The lift arm assembly 230 in turn supports an implement interface 270, which includes an implement carrier 272 that can receive and secure various implements to the loader 200 for performing various work tasks and power couplers, to which an implement can be coupled for selectively providing power to an implement that might be connected to the loader. Power couplers can provide sources of hydraulic or electric power or both. The loader 200 includes a cab 250 that defines an operator station 255 from which an operator can manipulate various control devices 260 to cause the power machine to perform various work functions. Cab 250 can be pivoted back about an axis that extends through mounts 254 to provide access to power system components as needed for maintenance and repair.

The operator station 255 includes an operator seat 258 and a plurality of operation input devices, including control levers (e.g., as control devices 260) that an operator can manipulate to control various machine functions. Operator input devices can include buttons, switches, levers, sliders, pedals and the like that can be stand-alone devices such as hand operated levers or foot pedals or incorporated into hand grips or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 200 include control of the tractive elements 219, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include and/or interacting with the embodiments discussed herein can have various different frame components that support various work elements. The elements of frame 210 discussed herein are provided for illustrative purposes and frame 210 is not the only type of frame that a power machine on which the embodiments can be practiced can employ. Frame 210 of loader 200 includes an undercarriage or lower portion 211 of the frame and a mainframe or upper portion 212 of the frame that is supported by the undercarriage. The mainframe 212 of loader 200, in some embodiments is attached to the undercarriage 211 such as with fasteners or by welding the undercarriage to the mainframe. Alternatively, the mainframe and undercarriage can be integrally formed. Mainframe 212 includes a pair of upright portions 214A and 214B located on either side and toward the rear of the mainframe that support lift arm assembly 230 and to which the lift arm assembly 230 is pivotally attached. The lift arm assembly 230 is illustratively pinned to each of the upright portions 214A and 214B. The combination of mounting features on the upright portions 214A and 214B and the lift arm assembly 230 and mounting hardware (including pins used to pin the lift arm assembly to the mainframe 212) are collectively referred to as joints 216A and 216B (one is located on each of the upright portions 214) for the purposes of this discussion. Joints 216A and 216B are aligned along an axis 218 so that the lift arm assembly is capable of pivoting, as discussed below, with respect to the frame 210 about axis 218. Other power machines may not include upright portions on either side of the frame or may not have a lift arm assembly that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports a pair of tractive elements in the form of wheels 219A-D on either side of the loader 200.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is what is known as a vertical lift arm, meaning that the lift arm assembly 230 is moveable (i.e., the lift arm assembly can be raised and lowered) under control of the loader 200 with respect to the frame 210 along a lift path 237 that forms a generally vertical path. Other lift arm assemblies can have different geometries and can be coupled to the frame of a loader in various ways to provide lift paths that differ from the radial path of lift arm assembly 230. For example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the inventive concepts set forth in this discussion are limited by the type or number of lift arm assemblies that are coupled to a particular power machine.

The lift arm assembly 230 has a pair of lift arms 234 that are disposed on opposing sides of the frame 210. A first end 232A of each of the lift arms 234 is pivotally coupled to the power machine at joints 216 and a second end 232B of each of the lift arms is positioned forward of the frame 210 when in a lowered position as shown in FIG. 2. Joints 216 are located toward a rear of the loader 200 so that the lift arms extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. Cross member 236 provides increased structural stability to the lift arm assembly 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm assembly 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e., along a pre-determined path) as is the case in the lift arm assembly 230 shown in FIG. 2. Some power machines have lift arm assemblies with a single lift arm, such as is known in excavators or even some loaders and other power machines. Other power machines can have a plurality of lift arm assemblies, each being independent of the other(s).

An implement interface 270 is provided proximal to a second end 232B of the lift arm assembly 234. The implement interface 270 includes an implement carrier 272 that is capable of accepting and securing a variety of different implements to the lift arm 234. Such implements have a complementary machine interface that is configured to be engaged with the implement carrier 272. The implement carrier 272 is pivotally mounted at the second end 232B of the lift arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative ease. For example, machines with implement carriers can provide an actuator between the implement carrier and the lift arm assembly, so that removing or attaching an implement does not involve removing or attaching an actuator from the implement or removing or attaching the implement from the lift arm assembly. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes an implement power source 274 available for connection to an implement on the lift arm assembly 230. The implement power source 274 includes pressurized hydraulic fluid port to which an implement can be removably coupled. The pressurized hydraulic fluid port selectively provides pressurized hydraulic fluid for powering one or more functions or actuators on an implement. The implement power source can also include an electrical power source for powering electric actuators and/or an electronic controller on an implement. The implement power source 274 also exemplarily includes electrical conduits that are in communication with a data bus on the excavator 200 to allow communication between a controller on an implement and electronic devices on the loader 200.

Frame 210 supports and generally encloses the power system 220 so that the various components of the power system 220 are not visible in FIGS. 2-3. The arrangement of drive pumps, motors, and axles in power machine 200 is but one example of an arrangement of these components. As discussed above, power machine 200 is a skid-steer loader and thus tractive elements on each side of the power machine are controlled together via the output of a single hydraulic pump, either through a single drive motor as in power machine 200 or with individual drive motors. Various other configurations and combinations of hydraulic drive pumps and motors can be employed as may be advantageous.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 4:
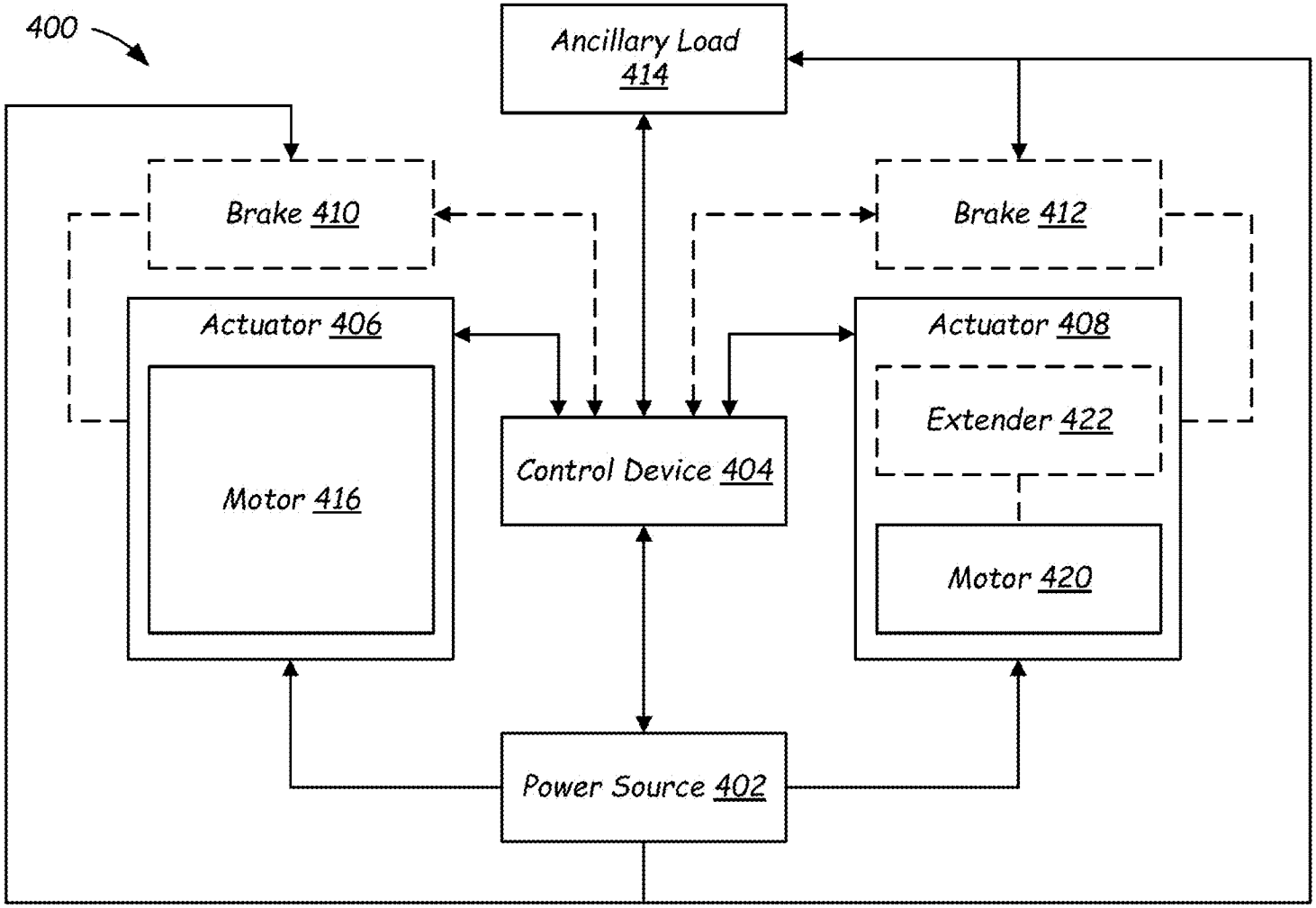
FIG. 4 is a block diagram illustrating components of a power system of a loader such as the loader of FIGS. 2 and 3.

FIG. 4 shows a schematic illustration of a block diagram of a power machine 400, which can be any of a number of different types of power machines (e.g., wheeled or tracked skid-steer loaders), including any of the types generally discussed above. To accomplish various work and drive operations, the power machine 400 can include a power source 402, a control device 404, and electric actuators 406, 408. Either or both of the electric actuators 406, 408 can be variously configured as one or more drive actuators, or one or more workgroup actuators, and a different number of individual actuators can be provided than is generally shown in FIG. 4. For example, as further discussed below, some power machines can include a left-side and right-side drive actuators, each including a respective electronic drive motor disposed to power an associate tractive element (e.g., an endless track assembly), as well as various extendable (or other) work actuators (e.g., one or more extendable lift arm actuators, one or more extendable tilt actuators, etc.). In some cases, as also shown in FIG. 4, one or more brakes 410, 412 can be configured to stop movement of an associated one or more of the actuators 406, 408, including based on control signals from the control device 404.

In the illustrated example, the power machine 400 can be an electrically powered power machine and thus the power source 402 can include an electrical power source such as, for example, a battery pack that includes one or more battery cells (e.g., lithium-ion batteries). In some embodiments, the power source 402 can include other electrical storage devices (e.g., a capacitor), and other power sources. In addition, the power machine 400 can, but need not, include an internal combustion engine that provides, via a generator, electrically power to the power source 402 (e.g., to charge one or more batteries of the electrical power source).

Generally, the control device 404 can be implemented in a variety of different ways and can include one or more types or instances of known electronic controllers. For example, the control device 404 can be implemented as known types of processor devices, (e.g., microcontrollers, field-programmable gate arrays, programmable logic controllers, logic gates, etc.), including as part of one or more general or special purpose computers. In addition, the control device 404 can also include or be in operative communication with other computing components, including memory, inputs, output devices, etc. (not shown). In this regard, the control device 404 can be configured to implement some or all of the operations of the processes described herein, which can, as appropriate, be retrieved from or otherwise interact with memory. In some embodiments, the control device 404 can include multiple control devices (or modules) that can be integrated into a single component or arranged as multiple separate components. In some embodiments, the control device 404 can be part of a larger control system (e.g., the control system 160 of FIG. 1) and can accordingly include or be in electronic communication with a variety of control modules, including hub controllers, engine controllers, drive controllers, and so on.

In different embodiments, different types of actuators can be configured to operate under power from the power source 402, including electric actuators configured as rotary actuators, linear actuators, and combinations thereof. In the example shown in FIG. 4, the actuator 406 is a drive actuator and includes an electrical motor 416 that is configured to provide rotational power to one or more tractive elements (not shown in FIG. 4). As noted above, some power machines can include multiple drive actuators, including as can be arranged for skid-steer operation.

Also as shown in the example of FIG. 4, the actuator 408 is a workgroup actuator and thus includes an electrical motor 420 that is configured to provide rotational power for operation of one or more non-drive work elements (e.g., a lift arm, an implement, etc.). In some cases, the motor 420 can be configured to power movement of an extender 422 (e.g., a lead screw, a ball screw, another similar threaded assembly, or other known components for rotationally powered non-rotational movement), which can convert rotational power of the motor 420 into translational movement of the extender 422 so as to provide translational power to a work element of the power machine 400. For example, the motor 420 can rotate in a first direction to drive extension of the extender 422 and can rotate in a second direction to drive retraction of the extender 422 when the motor rotates in a second rotational direction opposite the first rotational direction. In this way, and depending on how the electric actuator 406 is coupled to the components of the power machine 400, extension (and retraction) of the electric actuator 406 can, for example, raise (or lower) a lift arm of the power machine 400, change an attitude an implement of the power machine 400 (e.g., a bucket), etc.

Thus, generally, each motor 416, 420 can be controlled to implement particular functionality for the power machine 400. As generally noted above, different configurations of multiple drive or workgroup actuators can be included in some cases (e.g., multiple instances of the actuators 406, 408 as shown), to provide different functionality for a particular power machine. For example, in some configurations, the power machine 400 can include an electric actuator that is a first lift actuator on a first lateral side of the power machine 400, an electric actuator that is a second lift actuator on a second lateral side of the power machine 400, an electric actuator that is a first tilt actuator that is on a first lateral side of the implement interface of the power machine 400, an electric actuator that is a second tilt actuator that is on a second lateral side of the implement interface of the power machine 400, an electric actuator that is a first drive actuator for a first drive system that is on (or otherwise powers one or more tractive elements for) the first lateral side of the power machine 400, and an electric actuator that is a second drive actuator for a second drive system that is on (or otherwise powers one or more tractive elements for) the second lateral side of the power machine 400.

As also noted above, the brakes 410, 412 can be coupled to (e.g., included in) the respective electric actuators 406, 408 in some embodiments. In this regard, a wide variety of known brake systems can be used. For example, one or more brakes can be a mechanical brake that includes a mechanical stop that can be moved into engagement to block movement of a relevant extender or relevant motor, in one or more directions, and can be moved out of engagement to allow movement of the relevant extender or motor. In some cases, a mechanical brake can include an arm that contacts a lead screw of an extender to block further movement of the lead screw. In some embodiments, one or more electrically powered brakes can be provided (i.e., brake assemblies that include one or more electric actuators for application of braking force).

As shown in FIG. 4, the power source 402 can be electrically connected to the control device 404, the electric actuators 406, 408, and the brakes 410, 412 (as appropriate), as well as one or more ancillary loads 414. Thus, the power source 402 can provide power to each motor 416, 420 to drive movement (e.g., extension and retraction) of the respective extenders 418, 422, to the control device 404, to each brake 410, 412 (as appropriate), to each of the ancillary load(s) 414, etc. Further, the power source 402 can provide power to the ancillary loads 414 (i.e., loads not associated with providing tractive or workgroup power) for various ancillary functionality. For example, ancillary loads 414 can include a climate control system (e.g., including a heater, an air-conditioning system, a fan, etc.), a sound system (e.g., a speaker, a radio, etc.), etc. In some cases, ancillary loads 414 may be treated with lower priority according to certain power management modes.

As shown in FIG. 4, the control device 404 can be in electrical communication with the power source 402, the actuators 406, 408, the brakes 410, 412 (as appropriate), and the ancillary load(s) 414, and can adjust (e.g., limit) the power delivered from the power source 402 to, or the power consumed by, each of these electrical loads (or others). For example, as appropriate, the control device 404 can adjust (e.g., decrease) the power delivered to each of these electrical loads by adjusting (e.g., decreasing) the current that can be consumed by at least some of these electrical loads. In some cases, the control device 404 can adjust the current delivered to an electrical load by adjusting a driving signal delivered to a current source (e.g., a voltage controlled current source) that can be electrically connected to the electrical load (e.g., integrated within a power electronics driver board, such as a motor driver) to deliver current to the electrical load. For example, the current source can include one or more field-effect transistors, and the driving signal can be the voltage applied to the one or more field-effect transistors to adjust the current delivered and thus the power delivered to the electrical load (e.g., the motor).

In some embodiments, similarly to each of the electrical loads of the power machine 400, the electrical power source of the power source 402 can include (or can be otherwise electrically connected to) a current source (e.g., a power electronics board) that adjusts (e.g., and can restrict) the amount of power to be delivered to the electrical loads of the power machine 400. In this case, the control device 404 can adjust the driving signal to the electrical power source to adjust the total amount of current and thus the amount of power delivered to the electrical loads of the power machine 400. For example, the control device 404 can adjust the output from the electrical power source 402 to regulate the torque, position, direction, and speed of one or more motors powered by the power source 402.

In some embodiments, the control device 404 can be configured to determine a present (i.e., temporally current) power usage of one or more actuators or other electrical loads, or a present power delivery from a power source. In some cases, a present power usage or delivery can be measured instantaneously. In some cases, a present power usage or delivery can be measured as an average power delivery over a recent time interval (e.g., a preceding 2 seconds). Thus, for example, the control device 404 can determine a present power usage for each electrical load of the power machine 400, or can determine a present power delivery from the electrical power source of the power source 402.

In some cases, each electrical load of the power machine 400, and the power source 402 can include or can otherwise be electrically connected to a current sensor to determine the current being provided to (or by) the particular electrical component, and a voltage being provided to (or by) the particular electrical component can also be determined (e.g., based on voltage sensor or a fixed voltage provided by the power source 402). In this way, for example, the control device 404 can receive information about a present voltage and a present current that is delivered to each individual electrical load, or about the present voltage and current that is supplied by the electrical power source of the power machine 400 in total and can thereby determine a present power usage for relevant (e.g., all) electrical loads and for the electrical power source of the power machine 400.

In some embodiments, the control device 404 can determine a present power usage for the electrical power source of the power machine 400 by adding the present power usage for each relevant electrical load of the power machine 400 (e.g., as determined by multiplying current and voltage for the loads). Alternatively, for example, power can be determined by multiplying the torque and speed of one or more relevant motors. In certain circumstances, it may be advantageous to use either of these known methods. In other cases, the control device 404 can determine a present power usage of the electrical power source of the power machine 400 only by determining the power delivered by the electrical power source. For example, the control device 404 can receive a present value for current delivered by the electrical power source 402 and, based on the voltage of the electrical power source 402, can then determine a total present power usage for the electrical power source 402. In some cases, the control device 404 can assume a substantially constant voltage for the electrical power source 402 and can then determine the present power usage of the electrical power source 402 by using the constant voltage and the present electric current value.

In some embodiments, the electrical power source 402 can include or can be electrically connected to a sensor to sense a present remaining energy of the electrical power source. In some cases, for example, a voltage sensor can sense the voltage of the electrical power source, which can be indicative of the present remaining energy left within the electrical power source 402 (e.g., because the voltage of the electrical power source 402 can be related to the present remaining energy within the electrical power source 402). Any suitable means for sensing the remaining energy of the electrical power source 402 can be used, including an accounting of how much electric current is supplied by the electrical power source 402 over time.

Figure 5:
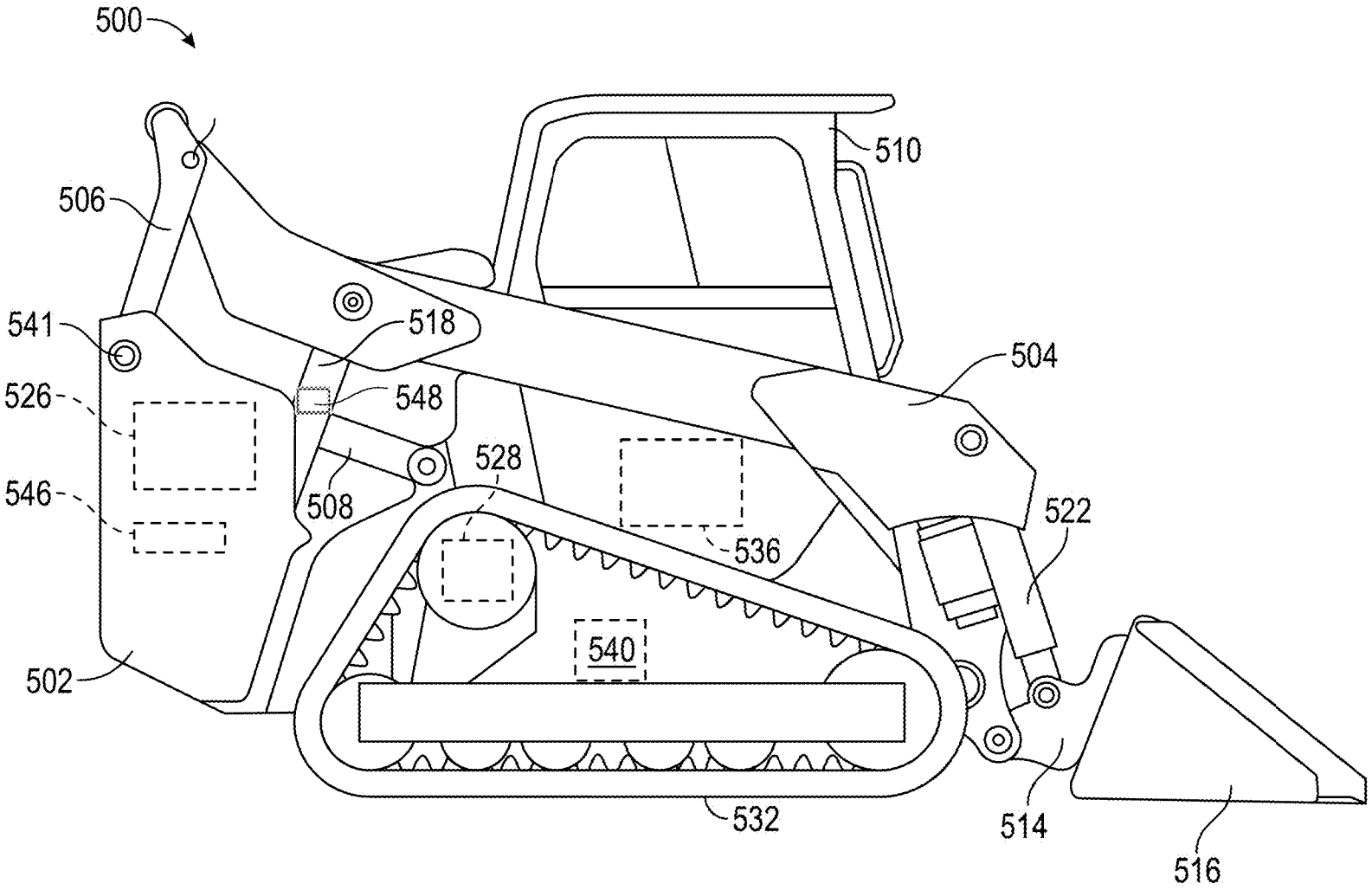
FIG. 5 is a side elevation view showing certain components of a power machine in the form of an electrically powered compact tracked loader according to configurations of the disclosure.

In some embodiments, the power machine 400 can include one or more sensors that can sense various aspects of the power machine 400. For example, the power machine 400 can include a torque sensor for one or more electric actuators, to sense a present torque of the one or more electric actuator. In some cases, the torque sensor can be the same as the electric current sensor electrically connected to the electric actuator (e.g., because electric current is related to the torque). As another example, the power machine 400 can include a position sensor for one or more extenders or other components of one or more electric actuators (as appropriate), including as may sense a present extension amount for an extender of an electric actuator (e.g., relative to the housing of the electric actuator). In some cases, this can be a hall-effect sensor, a rotary encoder for the motor (e.g., which can be used to determine the extension amount of actuators with extenders), an optical sensor, etc. In some cases, as shown in FIG. 5, the power machine 400 can include a resolver 548 configured to track relative movement of the actuator 518. As yet another example, the power machine 400 can include an angle sensor for one or more pivotable joints (e.g., of the lift arm) to determine a present orientation of the lift arm (and any implement coupled thereto). As yet another example, the power machine 400 can include a speed sensor or an acceleration sensor (e.g., an accelerometer) to respectively determine a present speed or a present acceleration of the entire power machine 400 or of a component thereof. As still yet another example, the power machine 400 can include an inclinometer (e.g., an accelerometer) that can sense the present attitude of a mainframe of the power machine 400 with respect to gravity.

FIG. 5 shows a side isometric view of an electrically powered power machine 500 with a lift arm in a fully lowered position, which can be a specific implementation of the power machine 200, the power machine 400, etc. As shown in FIG. 5, the power machine 500 can include a main frame 502, a lift arm 504 coupled to the main frame via a follower link 506, a driver link 508 pivotally coupled to the lift arm 504 and the main frame 502, an operator enclosure 510 (e.g., a cab, as shown), an implement interface 514 coupled to an end of the lift arm 504, an implement 516 (e.g., a bucket as shown) coupled to the implement interface 514, an electrical lift actuator 518, an electrical tilt actuators 522, an electrical power source 526, a drive system 528 (e.g., including an electrical drive motor), a traction devices 532 (e.g., an endless track, as shown), and a climate control system 536 (e.g., as generally representative of an ancillary electrical load). In some embodiments, a suspension system 540 (e.g., a torsional suspension system) can be included, to provide improved ride control and overall smoothness of travel. As generally noted above, similar (e.g., substantially identical) other components can be provided symmetrically (or otherwise) on an opposing lateral side of the power machine 500 in some cases, including another electrical lift actuator, another electrical tilt actuator, etc.

In some cases, the electrical power source 526 can be implemented in a similar manner as the previously described power sources (e.g., the power source 402). Thus, the electrical power source 526 can include a battery pack including one or more batteries. In general, the electrical power source 526 can supply power to some or all of the electrical loads of the power machine 500. For example, the electrical power source 526 can provide power to the lift electric actuator 518, the electrical tilt actuator 522, the drive system 528, the climate control system 536, etc.

The power machine 500 can also include a control device 546 that can be in communication with the power source 526 and some (or all) of the electrical loads of the power machine 500, as appropriate. For example, the control device 546 can be in communication with the lift electric actuator 518, the electrical tilt actuator 522, the drive system 528, the climate control system 536, etc. In this way, the control device 546 can control operation of these components, or related other systems, to adjust how power is routed to each of these electrical loads (e.g., depending on the criteria defined by the particular power management mode) and, correspondingly, how power from the power source 526 is consumed over a given operational function or interval of time.

Figure 6:
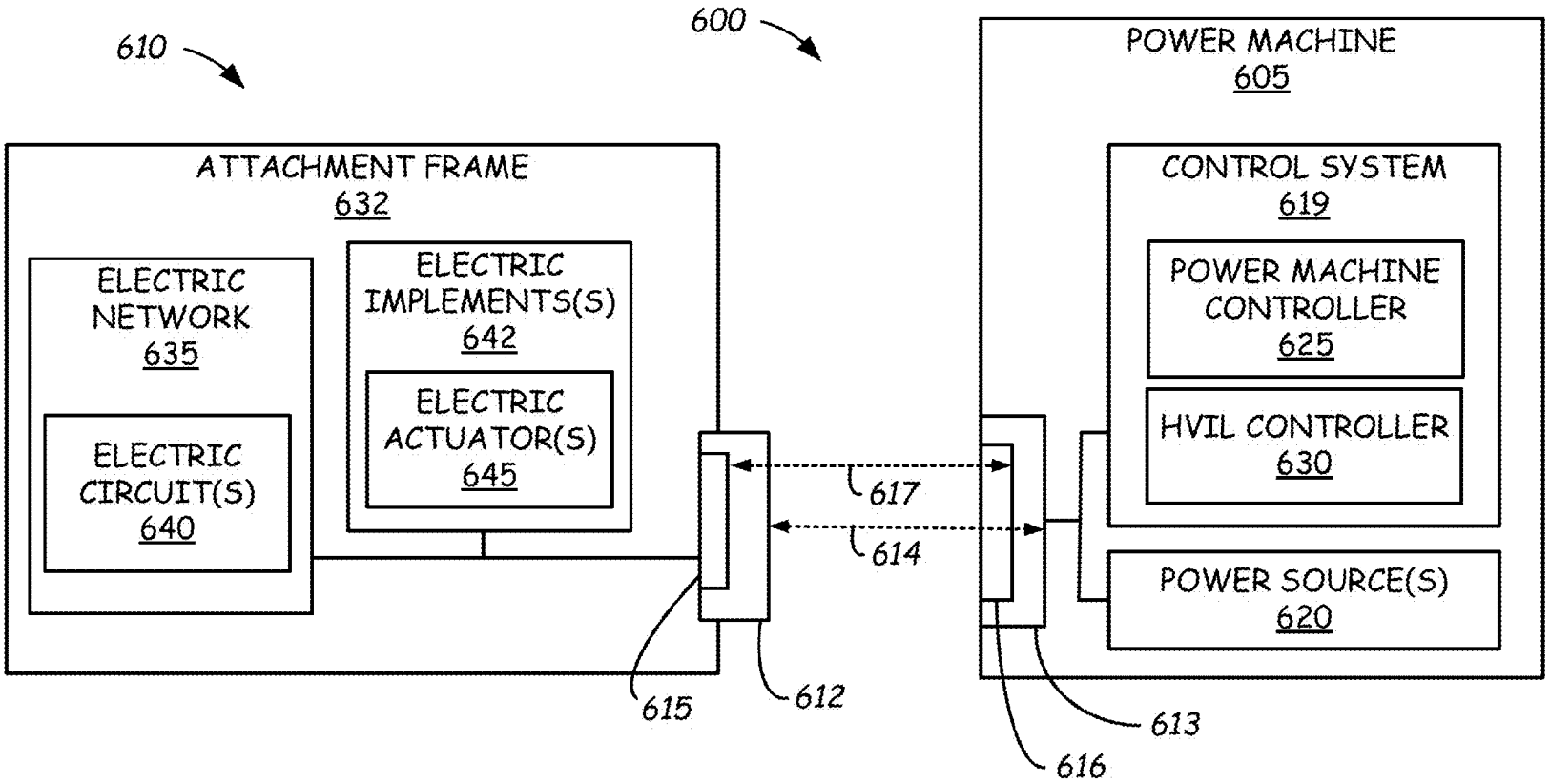
FIG. 6 illustrates a system for providing power management and diagnostics for a power machine according to some configurations.

FIG. 6 is a schematic block diagram of a system 600 for controlling a power system for a power machine 605 according to some configurations, and, in particular, for detecting faults related to transmission of electric power from the power machine 605 to a removably secured electric attachment or implement. In the illustrated example, the system 600 includes the power machine 605 (for example, the power machine 100 of FIG. 1, the loader 200 of FIGS. 2-3, or the power machine 500 of FIG. 5) and an attachment assembly 610. In some configurations, the system 600 includes fewer, additional, or different components than illustrated in FIG. 6.

The attachment assembly 610 and the power machine 605 may be removably coupled to each other using any of a variety of mechanical (and other) connections. Thus, for example, the attachment assembly 610 can include an attachment-side interface 612 and the power machine 605 can include a machine-side interface 613 (e.g., the implement interface 170). The machine-side interface 613 can be configured to receive the attachment-side interface 612 (as illustrated by the dashed arrow 614 of FIG. 6). When the machine-side interface 613 receives the attachment-side interface 612, the attachment assembly 610 may be physically coupled to the power machine 605 (as described in greater detail herein with respect to the implement interface 170).

Additionally, when the machine-side interface 613 receives the attachment-side interface 612, the attachment assembly 610 may be electrically coupled to the power machine 605 (e.g., electrically coupled to one or more electrical components or systems of the power machine 605). For instance, as illustrated in FIG. 6, the attachment-side interface 612 may include a connector or plug 615 (also referred to herein as "the attachment-side connector 615") and the machine-side interface 613 may include a connector or plug 616 (also referred to herein as "the machine-side connector 616"). When the machine-side connector 616 and the attachment-side connector 615 are coupled (as represented by the dashed arrow 617 in FIG. 6), the attachment assembly 610 (or component(s) thereof) may be electrically coupled to the power machine 605 (or component(s) thereof), as described in greater detail herein.

Certain aspects of the connectors (e.g., the attachment-side connector 615 or the machine-side connector 616) that are particular to an HVIL are further discussed below. However, with respect to general transmission of electrical power and maintenance of secure mechanical connections, any variety of mechanical and electrical structures can be used.

As illustrated in FIG. 6, the power machine 605 may include a control system 619 (e.g., the control system 160, as described herein), a power source 620 (e.g., the power source 120, 222, 402, 526, as described above), and the machine-side interface 613 (e.g., the implement interface 170, 270, as described above), which may include the machine-side connector 616. The control system 619, the power source 620, and the machine-side interface 613 may communicate over one or more communication lines or buses, such as, e.g., a controller area network ("CAN") bus. The power machine 605 may include additional, fewer, or different components than those illustrated in FIG. 6 in various configurations and may perform additional functionality than the functionality described herein. For example, the power machine 605 may include additional, similar, or different components, systems, and functionality as described above with respect to the power machine 100 of FIG. 1, the loader 200 of FIGS. 2-3, or the power machine of FIG. 5.

As also generally described with respect to FIGS. 1-5, the power source 620 may provide power to one or more components of the power machine 605, such as, e.g., a work element, a tractive element, an implement coupler that may receive power to removably couple an attachment or implement to the power machine 605, another component of the power machine 505, or a combination thereof. Alternatively, or in addition, in some configurations, the power source 620 may power one or more auxiliary loads via the machine-side interface 613 or other interface (e.g., may thus power the auxiliary load 414, as described herein, or an electrical load of an attachment assembly that is electrically coupled to the power machine 605 and the power source 620 via the machine-side interface 613). The power source 620 may provide power indirectly to the component(s) of the power machine 605, the attachment assembly 610, or a combination thereof. For example, the power source 620 can provide power to the control system 619, which in turn may selectively provide power to the relevant component(s).

In the illustrated example, the power source 620 is an electrical power source, such as, e.g., an electric generator, a rechargeable battery, various other power sources or any combination of power sources that can provide power for given power machine components. In some configurations, the power source 620 may include electrical sources alone or in combination with an internal combustion engine. In some specific embodiments, the power source 620 may be an internal combustion engine coupled with an electric generator.

Figure 10:
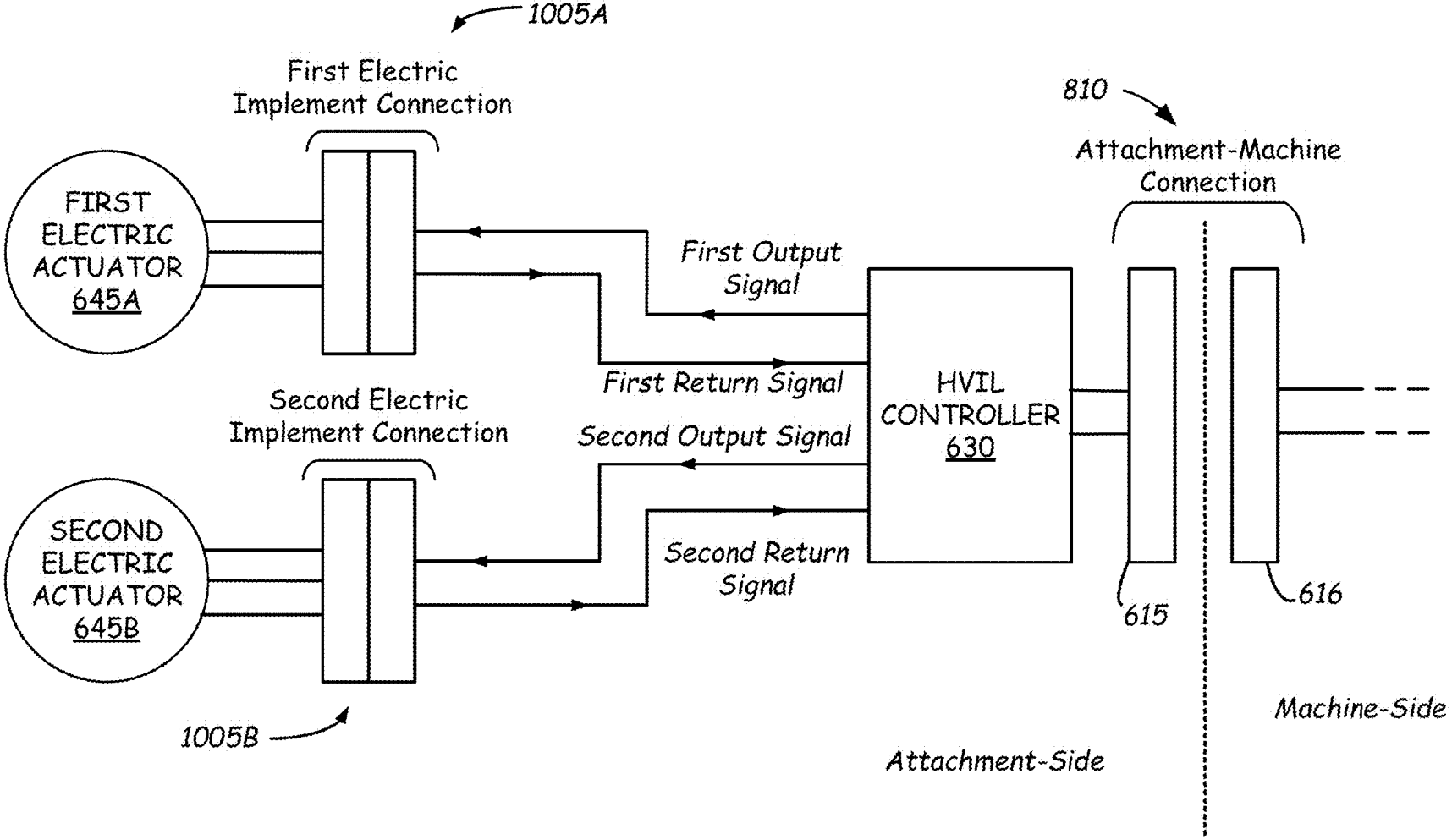
FIG. 10 schematically illustrates another example implementation with multiple electrically powered implements and HVIL electric circuits according to some configurations.

As illustrated in FIG. 6, the control system 619 includes a power machine controller 625 (e.g., the control device 404, as described herein) and an HVIL controller 630. In some configurations, the control system 619 may include fewer, additional, or different components than illustrated in FIG. 6. In some configurations, the power machine controller 625 and/or the HVIL controller 630 may be a dedicated or stand-alone controller(s). In some configurations, the power machine controller 625 or the HVIL controller 630 can be part of a system of multiple distinct controllers (e.g., a hub controller, drive controller, workgroup controller, etc.) or can be formed by a system of multiple distinct controllers (e.g., also with hub, drive, and workgroup controllers, etc.). In some configurations, the power machine controller 625 or the HVIL controller 630 may be positioned on or with respect to another component of the system. As one example, the HVIL controller 630 may be included as a component of the attachment assembly 610 (as illustrated in FIG. 10). In some configurations, the functionality described herein as being performed by the power machine controller 625 or the HVIL controller 630 may be distributed between multiple controllers included as components of the power machine 605, the attachment assembly 610, or a combination thereof. In some configurations, the functionality (or a portion thereof) described herein as being performed by the HVIL controller 630 may be performed by the power machine controller 625. Alternatively, or in addition, in some configurations, the functionality (or a portion thereof) described herein as being performed by the power machine controller 625 may be performed by the HVIL controller 630. For instance, in some examples, functionality performed by the power machine controller 625 and the HVIL controller 630 may be performed by a single control device or controller (i.e., the power machine controller 625 and the HVIL controller 630 may be combined into a single control device or controller).

The power machine controller 625 may be configured to receive operator input or other input signals (e.g., sensor data, such as the operational data) and to output commands accordingly to control operation of the power machine 605. For example, the power machine controller 625 can communicate with other systems of the power machine 605 to perform various work tasks, including to control tractive and implement actuators for travel and operations over the course of a work event or cycle. In some configurations, the power machine controller 625 receives input from an operator input device, including input as command signals provided by an operator of the power machine 605 via the operator input device. In response to receiving the input, the power machine controller 625 may control the power machine 605 to perform a work task based at least in part on the input received from the operator input device.

The HVIL controller 630 may perform power management and diagnostic functions for the system 600, including, e.g., the power machine 605, the attachment assembly 610, or a combination thereof. In some configurations, the HVIL controller 630 may perform the power management and diagnostic functions described herein based on the transmission of electric signals (e.g., output signal(s), return signal (s), etc.) through electrical networks or systems of the power machine 605, the attachment assembly 610, or a combination thereof. Alternatively, or in addition, the HVIL controller 630 may perform the power management and diagnostic functions described herein based on input received from an operator input device (e.g., command signals provided by an operator of the power machine 605 via the operator input device(s)), other data associated with the power machine 605 or the attachment assembly 610, or a combination thereof.

In some examples in particular, as further discussed herein, the control system 619 (via, e.g., the power machine controller 625 or the HVIL controller 630) can manage and diagnose high-voltage power connections of the power machine 605 and can control the supply (or routing) of power from the power source 620 to the attachment assembly 610 (or an electric load or implement thereof). Alternatively, or in addition, in some configurations, the control system 619 (via, e.g., the power machine controller 625 or the HVIL controller 630) may generate or issue an alert or error code based on the high-voltage power connections of the power machine 605. Such alerts or error codes may be stored or transmitted to an operator of the power machine 605 (e.g., via one or more human-machine interfaces, including display devices, of the power machine 605 or a remote device).

Figure 7:
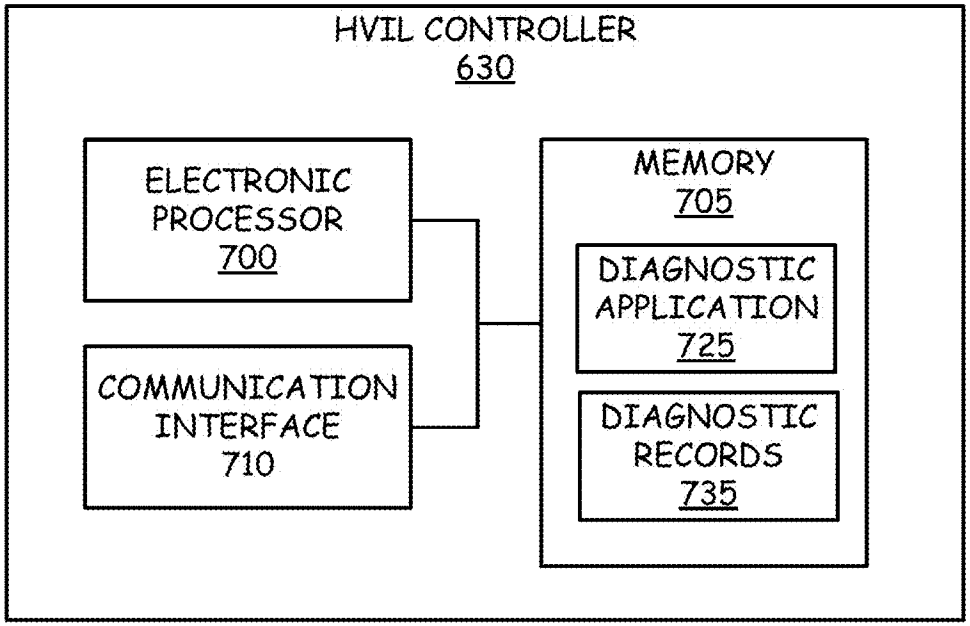
FIG. 7 schematically illustrates a controller of the power machine of FIG. 7 according to some configurations.

FIG. 7 illustrates the HVIL controller 630 according to some configurations. In the illustrated example of FIG. 7, the HVIL controller 630 includes an electronic processor 700 (for example, a microprocessor, an application-specific integrated circuit ("ASIC"), or another suitable electronic device), a memory 705 (for example, a non-transitory, computer-readable medium), and a communication interface 710. The electronic processor 700, the memory 705, and the communication interface 710 communicate over one or more communication lines or buses. It should be understood that the HVIL controller 630 may include additional components than those illustrated in FIG. 7 in various configurations and may perform additional functionality than the functionality described herein. For example, in some configurations, the functionality described herein as being performed by the HVIL controller 630 may be distributed among other components or devices.

The communication interface 710 allows the HVIL controller 630 to communicate with devices external to the HVIL controller 630. For example, as illustrated in FIG. 6, the HVIL controller 630 may communicate with the electric actuator(s) 645, the electric network 635, including one or more of the electric circuits 640, another component of the attachment assembly 610, or a combination thereof through the communication interface 710. Alternatively, or in addition, in some configurations, the HVIL controller 630 may communicate, via the communication interface 710, with components external to the attachment assembly 610, such as, e.g., the power machine 605 (or components thereof), a remote computing device, etc. For example, in some configurations, the HVIL controller 630 and the power machine controller 625 may communicate with each other as part of performing the power management and diagnostic functionality (or a portion thereof) described herein.

The electronic processor 700 is configured to access and execute computer-readable instructions ("software") stored in the memory 705. The software may include firmware, one or more applications, program data, filters, rules, one or more program modules, and other executable instructions. For example, the software may include instructions and associated data for performing a set of functions, including the methods described herein.

As one example, as illustrated in FIG. 7, the memory 705 may store a diagnostic application 725 (referred to herein as "the application 725") and a set of diagnostic records 735 (referred to herein collectively as "the diagnostic records 735" and individually as "the diagnostic record 735"). Alternatively, or in addition, in some configurations, the application 725, the diagnostic record(s) 735, or a combination thereof may be stored remotely, such as, for example, in a memory of remote device, server, or database, such that the application 725, the diagnostic record(s) 735, or a combination thereof are accessible by the HVIL controller 630.

The application 725 is a software application executable by the electronic processor 700. As described in greater detail herein, the electronic processor 700 may execute the application 725 for performing power management and diagnostics for the power machine 605 or the attachment assembly 610. In general, the application 725 (when executed by the electronic processor 700) may generate a set of output signals for transmission to an electric network of attachment assembly 610 (e.g., a HVIL of the attachment assembly 610) and receive a set of return signals from the electric network.

As described in greater detail herein, an "output signal" and a "return signal" may refer to a signal that is transmitted through an HVIL electric circuit in order to diagnose a connection (e.g., a high-voltage connection between a power source of the power machine 605 and the attachment assembly 610). When the HVIL controller 630 outputs the signal to the HVIL electric circuit, the signal may be referred to has an "output signal." In other words, the signal provided to (or otherwise received by) the HVIL electric circuit may be referred to as an "output signal." The signal (the "output signal") may be forwarded or transmitted along the HVIL electric circuit, and, ultimately, the signal is returned to the HVIL controller 630. The signal returned to the HVIL controller 630 from the HVIL electric circuit may be referred to as a "return signal." As described in greater detail herein, transmission (or forwarding) of the signal through the HVIL electric circuit may impact the signal such that, in at least some instances, the return signal may differ from the output signal. For instance, as a result of being transmitted through the HVIL electric circuit, a characteristic or value of the signal may be changed. For example, the output signal may have a voltage of 12V while the return signal may have a voltage of 6V.

In some instances, the HVIL controller 630 may provide an output signal to the HVIL electric circuit, but may not receive a corresponding return signal. For example, in some cases, the HVIL electric circuit may be severed or damaged such that the output signal cannot return, as a return signal, to the HVIL controller 630 (as described in greater detail herein). In instances where the HVIL controller 630 does not receive a corresponding return signal, the return signal may refer to or include the absence or lack of a corresponding return signal. Accordingly, as used herein, in some instances, a "return signal" may include no signal (e.g., 0 V). While the technology disclosed herein is described as receiving a return signal, it should be understood that in some instances receiving a return signal may include receiving no signal, detecting the absence of a return signal (e.g., detecting 0V at a connection point or plug associated with receipt of a return signal), etc.

The application 725 (when executed by the electronic processor 700) may process or analyze the return signal(s), the output signal(s), or a combination thereof to determine a status of the power machine 605 or the attachment assembly 610. In some examples, the status may refer to a connection status with respect to a high-voltage connection between the power machine 605 and the attachment assembly 610, or an electric load or implement thereof. In some configurations, the status (or connection status) may include a fault status or a normal status. The fault status may indicate a fault or abnormal condition related to the connection (e.g., a disconnection or a weak connection of the high-voltage connection). The normal status may indicate a normal condition related to the connection. Based on the status, the application 725 (when executed by the electronic processor 700) may determine whether to supply power from the power source 620 to the attachment assembly 610 or one or more components of the power machine 605. Accordingly, the application 725 (when executed by the electronic processor 700) may control the power source 620 (e.g., via the generation and transmission of one or more control signals). For example, the application 725 may generate and transmit control signal(s) directly to the power source 620. As another example, the application 725 may generate and transmit control signal(s) to the power machine controller 625, where, in response to receiving the control signal(s), the power machine controller 625 may control the power source 620 (e.g., by forwarding the control signal(s) or generating a new set of control signals based on the received control signal(s)). Alternatively, or in addition, in some configurations, the application 725 (when executed by the electronic processor 700) may maintain a diagnostic log (e.g., as the diagnostic record(s) 735), generate and transmit alerts or error codes to an operator of the power machine 605, or the like.

In some configurations, as illustrated in FIG. 7, the generated diagnostic records 735 may be stored locally (e.g., in the memory 705). Alternatively, or in addition, the generated diagnostic records 735 may be transmitted to a remote device for further processing (e.g., via the power machine controller 625, a user device, a remote server, or the like), for presentation to an end user or operator (e.g., via a remote user device, a display device of the power machine 605, etc.), for remote storage (e.g., a memory of the power machine controller 625, at a remote database, etc.), or the like. The diagnostic record 735 may include, e.g., operational data (as a data stream from one or more sensors of the power machine 605), an indication of a state of one or more high-voltage circuits of the power machine 605 and/or the attachment assembly 610 (e.g., a connected state, a disconnected state, a connection-unknown state, etc.), a predicted cause of a disconnected state (e.g., an identifier of a component predicted to be experiencing a disconnect, such as a specific connection point or connector), other associated data, or a combination thereof. Generally, the diagnostic record 735 may thus preserve historical operational parameters of the power machine 605, including whether the power machine 605 or the attachment assembly 610 has been in any fault states and any predicted causes of the fault states. Accordingly, in some instances, the diagnostic record 735 may function or serve as an error log for the power machine 605 or the attachment assembly 610.

Although not illustrated in FIG. 6, in some configurations, the power machine controller 625 may include similar components as described herein with respect to the HVIL controller 630. For example, in some configurations, the power machine controller 625 may include an electronic processor (for example, a microprocessor, an ASIC, or another suitable electronic device), a memory (for example, a non-transitory, computer-readable medium), a communication interface, and the like.

Returning to FIG. 6, the system 600 may also include the attachment assembly 610. As illustrated in FIG. 6, the attachment assembly 610 may include an attachment frame 632. The attachment frame 632 includes a physical structure that can support various other components that are attached thereto or positioned thereon. The attachment frame 632 can support any number of individual components. For instance, as illustrated in FIG. 6, the attachment frame 632 supports an electric network 635, which can include a set of electric circuits 640, one or more electric implements 642 (or attachments), which can include a set of one or more electric actuators 645 (referred to in combination herein as "the electric actuators 645" or individually as "the electric actuator 645"), and the attachment-side interface 612, which can include the attachment-side connector 615. In some configurations, the attachment assembly 610 includes fewer, additional, or different components than illustrated in FIG. 6. For example, in some configurations, the attachment assembly 610 may include the HVIL controller 630 (e.g., as illustrated in FIG. 10).

The electric actuator 645 may include any variety of electrically powered actuators, including, e.g., an electric motor configured to power work operations of an auger, a sweeper, a mulcher, a chipper, a breaker, a grapple, a saw, or any other variety of known work elements for an attachment or implement. Correspondingly, the electric actuator 645 may receive power from the power source 620 of the power machine 605. As noted above and further described below, the electric network 635 includes the electric circuits 640. In some configurations, the electric circuits 640 includes at least one power-transmission electric circuit and at least one HVIL electric circuit. In some configurations, the HVIL electric circuit may be a separate and distinct electric circuit from the power-transmission electric circuit. For example, the HVIL electric circuit can be arranged in parallel with a power-transmission electric circuit, such that power signals for the electric actuator(s) 645 are not transmitted along the HVIL electric circuit and monitoring signals for the HVIL electric circuit (as further discussed below) are not transmitted along the power-transmission electric circuit. In some further specific embodiments, the power-transmission electric circuit and the HVIL electric circuit may be run in the same wiring loom or bundle within one or both of the power machine 605 and the attachment assembly 610.

The power-transmission electric circuit facilitates the transmission or supply of power for the attachment assembly 610 (or a component thereof). For example, the power-transmission electric circuit may receive power from the power source 620 and route (or provide) the received power to an electrically powered component of the attachment assembly 610, such as, e.g., the electric actuator(s) 645. Accordingly, the power-transmission electric circuit may be associated with a high-voltage connection between the power machine 605 and the attachment assembly 610 (or a component thereof). For example, the power-transmission electric circuit may be configured to operate at 640 V.

The HVIL electric circuit facilitates the diagnostics with respect to the high-voltage connection of the power-transmission electric circuit, as described in greater detail herein. In some examples, the HVIL electric circuit receives output signals (e.g., generated and provided by the HVIL controller 630) and facilitates the return of corresponding return signals (e.g., to the HVIL controller 630). The HVIL electric circuit may be a low-voltage electric circuit configured to receive and output low-voltage signals (e.g., the output signals and the corresponding return signals). For example, the HVIL electric circuit may be configured to operate at 12 V.

The power-transmission electric circuit may connect one or more components in a specific connection sequence or order. In some configurations, the HVIL electric circuit may connect the same one or more components in the same connection sequence or order as the power-transmission electric circuit. Alternatively, in other configurations, the HVIL electric circuit may connect the one or more components in a different connection sequence or order as the power-transmission electric circuit, as described in greater detail herein. Alternatively, or in addition, in some configurations, the HVIL electric circuit may connect additional, different, or fewer components than the power-transmission electric circuit, as described in greater detail herein.

Figure 8:
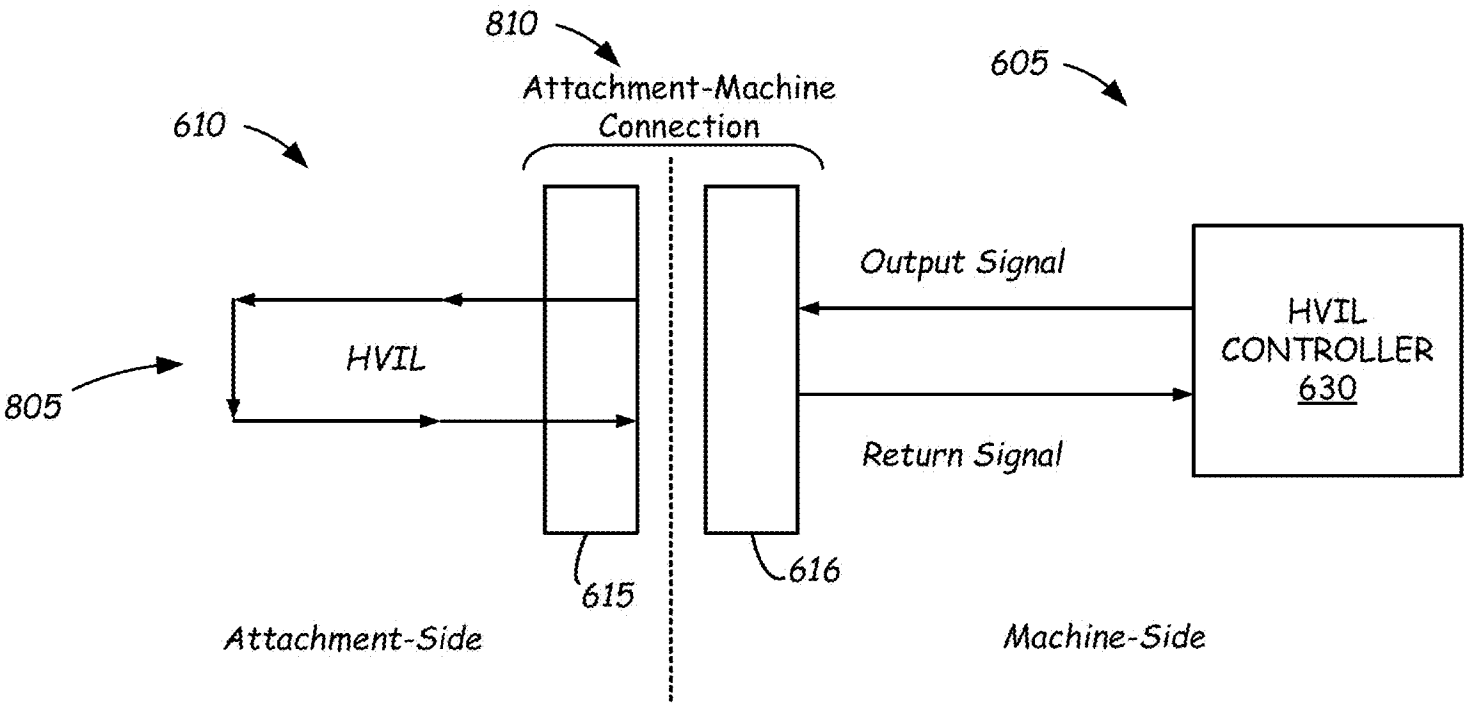
FIG. 8 schematically illustrates an example implementation of a HVIL electric circuit according to some configurations.

FIG. 8 schematically illustrates an example implementation of a HVIL electric circuit 805, where the HVIL electric circuit 805 is included in (and also extends beyond) an attachment-machine connection 810 (e.g., a connection formed via the attachment-side connector 615 and the machine-side connector 616) according to some configurations. As illustrated in FIG. 8, the HVIL controller 630 may generate an output signal to the machine-side connector 616 and receive a return signal, based on the output signal, via the machine-side connector 616. Accordingly, as further detailed in examples below, the HVIL controller 630 may determine a status of the attachment assembly 610 or the power machine 605 (e.g., a connection status of the attachment-machine connection 810 or between the attachment-side connector 615 and the machine-side connector 616).

In some configurations, the HVIL controller 630 may determine the status (or connection status) based on the output signal, the return signal, or a combination thereof. In some examples, the HVIL controller 630 may determine the status by comparing the output signal to the return signal. For instance, the HVIL controller 630 may determine a fault status or condition in response to determining that the return signal is different from the output signal. Such a difference between the output signal and the return signal may be indicative of a disconnection, abnormal connection, or unknown connection between two or more components included in the HVIL electric circuit (e.g., an open circuit). For example, where the HVIL loop of the HVIL electric circuit 805 is simply a conductor (e.g., wire) loop without a load, an output signal from the HVIL controller 630 may be expected to result in an identical return signal during normal operation. Thus, when the return signal is not the same as the output signal, a fault may be indicated (e.g., due to a loose engagement at the attachment-machine connection 810).

Relatedly, the HVIL controller 630 may determine a normal status or connection in response to determining that the return signal is substantially the same as the output signal (i.e., the same as the output signal, other than variations due to inherent resistances or interferences of the intervening circuit). For example, in the configuration noted immediately above, when the attachment-machine connection 810 (and other relevant connection(s)) is appropriately engaged, the HVIL may simply transmit the output signal to be returned to the HVIL controller 630 as an unchanged return signal with an identical voltage (or other) pattern. In some configurations, the HVIL controller 630 may determine a normal status or connection in response to determining that the return signal is within a predetermined range or threshold (e.g., the return signal is at least a predetermined percentage of the output signal). For example, when the return signal is at least 80% of the output signal, the HVIL controller 630 may determine a normal status or connection. As another example, when the return signal is less than 80% of the output signal, the HVIL controller 630 may determine a fault status or condition. As a specific example, when the output signal is 12 V, the HVIL controller 630 may determine a normal status or connection when the return signal is greater than or equal to 9.6 V.

Figure 9:
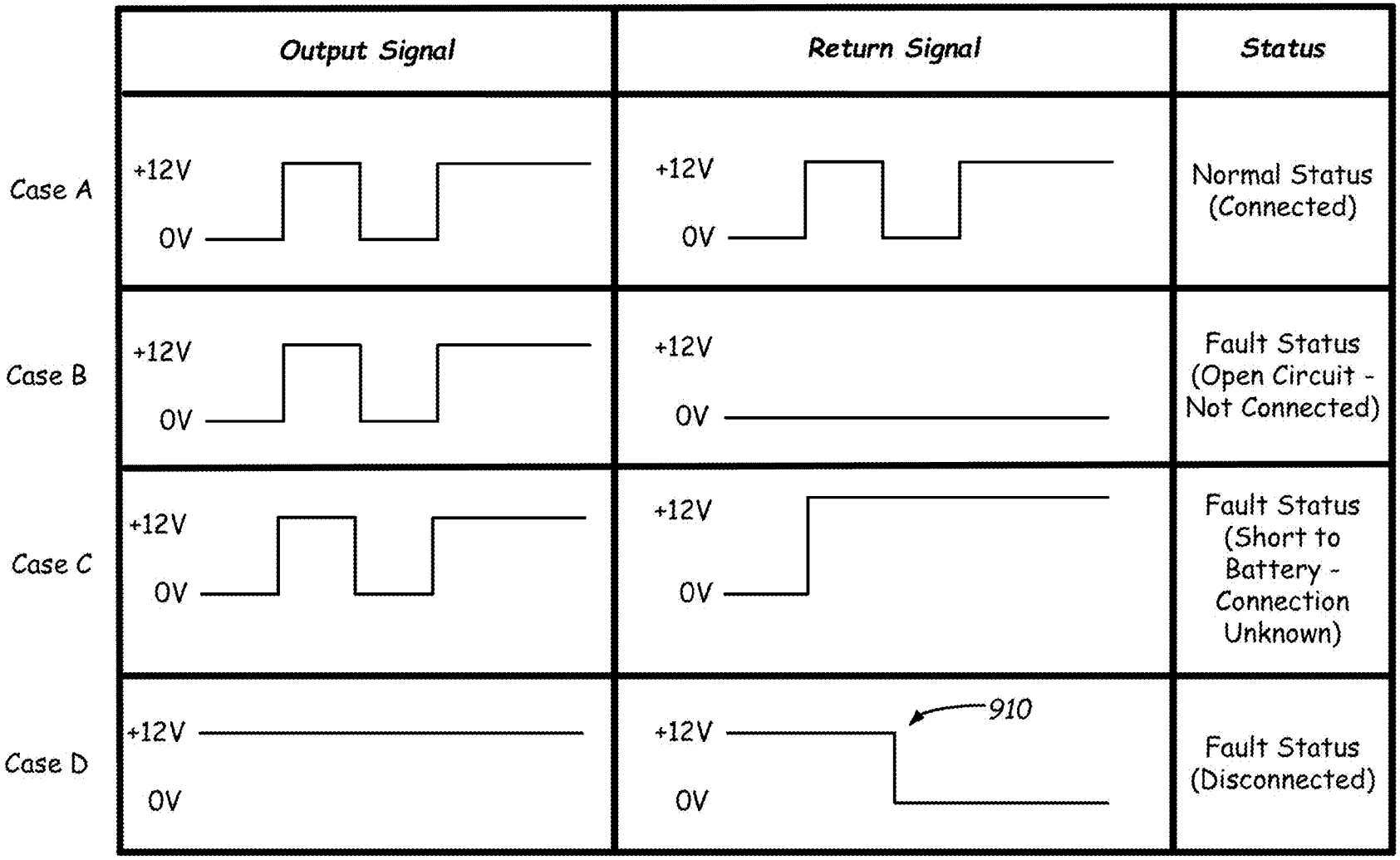
FIG. 9 illustrates a table including example output signals and corresponding example return signals according to some configurations.

In this regard, FIG. 9 is a table including a set of example output signals and corresponding example return signals according to some conditions of the HVIL electric circuit 805. With respect to Case A, the HVIL controller 630 may determine that the output signal and the return signal are substantially the same. In response, the HVIL controller 630 may determine the status for Case A to be a normal status corresponding to a relevant attachment assembly or component thereof being appropriately connected for high-voltage (i.e., operational) power transmission. With respect to Case B, the HVIL controller 630 may determine that the output signal and the return signal are not the same (i.e., are different). For instance, the return signal of Case B is 0V, which may be indicative of an open circuit that corresponds to the attachment assembly or component thereof not being appropriately connected (e.g., being loose or damaged) and, thus, not in condition for operational power transmission. Accordingly, for Case B, the HVIL controller 630 may determine the status to be a fault status (or a disconnected status).

With respect to Case C, the HVIL controller 630 may determine that the output signal and the return signal are not the same (i.e., are different). For instance, the return signal of Case C is 12V, which may be indicative of a short circuit and, ultimately, that the connection status of a relevant attachment assembly is unknown. Accordingly, for Case C, the HVIL controller 630 may determine the status to be a fault status (or unknown status). With respect to Case D, the HVIL controller 630 may also determine that the output signal and the return signal are not the same (i.e., are different). For instance, while an initial portion of the return signal of Case D matches the output signal, a latter portion of the return signal of Case D does not match the output signal. Such a change in the return signal may be indicative that the attachment-machine connection 810 was dropped or lost. The point at which the return signal no longer matches the output signal (represented in FIG. 9 by reference numeral 910) may indicate the point at which the disconnection occurred. Accordingly, for Case D, the HVIL controller 630 may determine the status to be a fault status (or disconnection status). Case D may be indicative of a situation where an operator disconnects an auxiliary connector for the implement while high-voltage is being delivered. In such an instance, the HVIL controller 630 may identify the disconnection of the HVIL electric circuit 805 and facilitate disabling power delivery from the power source 620 to the electric network 635 of the attachment assembly 610 (e.g., the power-transmission electric circuit).

In some embodiments, the auxiliary connector(s) of the HVIL electric circuit 805 may be disconnected prior to the high-voltage leads of the power-transmission electric circuit within the connector (e.g., due to imbalanced force moments being applied to a connector during a disconnect operation). In such a situation (or others), the HVIL controller 630 may identify the disconnection and disable power delivery to the high-voltage power-transmission electric circuit within a relatively short time frame, so as to facilitate disabling power delivery prior to the high-voltage leads decoupling and arcing.

A square wave pattern of output signals may be useful in particular to allow for regular interrogation of relevant connection status. However, in other examples, otherwise configured output signals can be used, with corresponding return signals indicating various connected or disconnected status.

In some configurations, the electric network 635 of the attachment assembly 610 may include additional HVIL electric circuits. For instance, in some configurations, the attachment assembly 610 may include multiple electric actuators 645. In such configurations, the electric network 635 of the attachment assembly 610 may include an HVIL electric circuit for each electric actuator 645. In some configurations, a system can include a similar arrangement with multiple attachments, each with corresponding electronic networks (e.g., each similar to the attachment assembly 610 of FIG. 6).

In this regard, FIG. 10 illustrates an example implementation of an HVIL circuit in communication with multiple electric actuators according to some configurations. As illustrated in FIG. 10, the implementation includes a first electric actuator 645A and a second electric actuator 645B (e.g., both on a single implement). The first electric actuator 645A is connected to the HVIL controller 630 via a first electric implement connection 1005A (e.g., a set of connectors). The second electric actuator 645B is connected to the HVIL controller 630 via a second electric implement connection 1005B (e.g., a set of connectors). As noted herein, in some configurations, the HVIL controller 630 may be included in the attachment assembly 610, as illustrated in FIG. 10.

As illustrated in FIG. 10, the HVIL controller 630 outputs a first output signal to the first electric implement connection 1005A and receives a corresponding first return signal. The HVIL controller 630 may output a second output signal to the second electric implement connection 1005B and receive a corresponding second return signal. The HVIL controller 630 may thus determine a status (e.g., a first status) for the first electric actuator 645A (or the first electric implement connection 1005A) based on the first output signal or the first return signal (e.g., a comparison of the first output signal and the first return signal). The HVIL controller 630 may determine a status (e.g., a second status) for the second electric actuator 645B (or the second electric implement connection 1005B) based on the second output signal or the second return signal (e.g., a comparison of the second output signal and the second return signal). Accordingly, the HVIL controller 630 may determine a status (or connection status) for each electric actuator 645 of the attachment assembly 610 based on an output signal or a return signal (or a comparison thereof) corresponding to each electric actuator 645.

Although the configuration of FIG. 10 illustrates the attachment-machine connection 810 as a single interface between a power machine and a single attachment (with the two implement connections 1005), variations are possible. For example, a similar arrangement can be used with the implement connections (e.g., the first electric implement connection 1005A or the second electric implement connection 1005B) instead representing attachment-machine connections, such that the first and second output signals can be used to monitor the status of two separate implements in parallel (or simultaneously).

Figure 11:
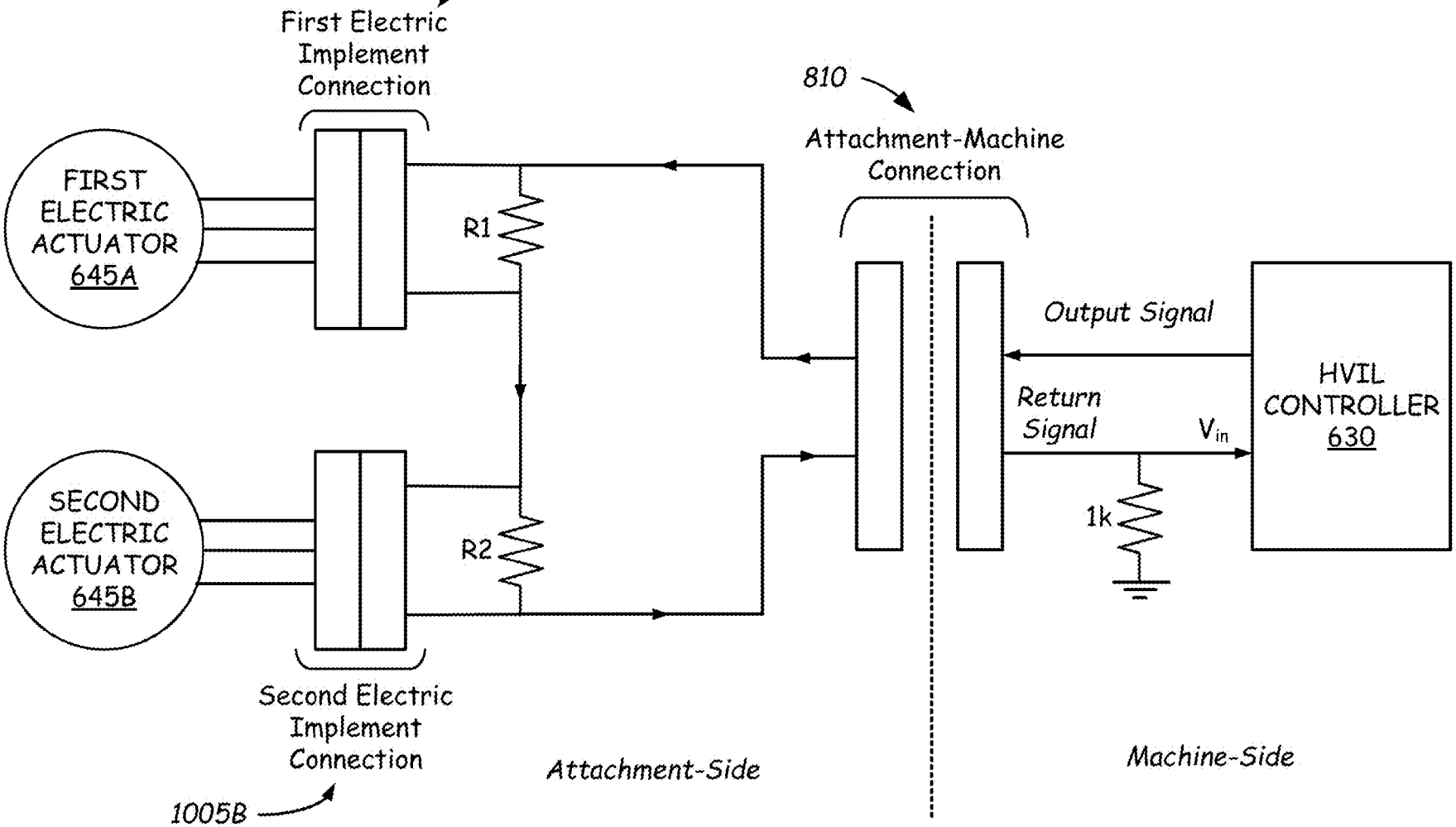
FIG. 11 schematically illustrates another example implementation with multiple electrically powered implements and a single HVIL electric circuit according to some configurations.

Alternatively, or in addition, in some configurations, the electric network 635 of the attachment assembly 610 may include a single HVIL electric circuit 805 for multiple electric actuators 645. For example, FIG. 11 illustrates another example implementation with multiple electric actuators 645 and a single HVIL electric circuit 805 according to some configurations. As illustrated in FIG. 11, the implementation includes the first electric actuator 645A, the second electric actuator 645B, the first electric implement connection 1005A, and the second electric implement connection 1005B. Also illustrated in FIG. 11, a first resistor R1 is positioned in parallel with the first attachment connection 1005A and a second resistor R2 is positioned in parallel with the second attachment connection 1005B. As illustrated in FIG. 11, the HVIL controller 630 may be positioned on a machine-side of the attachment-machine connection 810 (as opposed to on an attachment-side of the attachment-machine connection 810 as illustrated in FIG. 10). According to the example implementation of FIG. 11, the HVIL controller 630 may provide an output signal through the attachment-machine connection 810 and receive a corresponding return signal via the attachment-machine connection 810, where the corresponding return signal is based on whether electric current flows through the first resistor R1, the second resistor R2, both the first resistor R1 and the second resistor R2, or neither the first resistor R1 nor the second resistor R2.

For example, when the attachment-machine connection 810, the first electric implement connection 1005A, and the second electric implement connection 1005B are connected, the return signal may be the same (or substantially similar) to the output signal. As another example, when the attachment-machine connection 810 is not connected, the return signal will be different from the output signal (e.g., the return signal equals 0V). As another example, when the first electric actuator 645A or the first electric implement connection 1005A provides an open circuit (i.e., is disconnected) and the second electric actuator 645B or the second electric implement connection 1005B provides a closed circuit (i.e., is connected), the output signal will travel through the first resistor R1, which will result in a return signal dependent on the resistance of the first resistor R1. As another example, when the first electric actuator 645A or the first electric implement connection 1005A provides a closed circuit (i.e., is connected) and the second electric actuator 645B or the second electric implement connection 1005B provides an open circuit (i.e., is disconnected), the output signal will travel through the second resistor R2, which will result in a return signal dependent on the resistance of the second resistor R2. As yet another example, when the first electric actuator 645A or the first electric implement connection 1005A provides an open circuit (i.e., is disconnected) and the second electric actuator 645B or the second electric implement connection 1005B provides an open circuit (i.e., is disconnected), the output signal will travel through both the first resistor R1 and the second resistor R2, which will result in a return signal dependent on the resistances of the first resistor R1 and the second resistor R2 (e.g., the sum of the resistances of the first resistor R1 and the second resistor R2).

As such, where the resistance values are known or accessible by the HVIL controller 630, the HVIL controller 630 may determine a status based on the resistance(s), the return signal(s), the output signal(s), or a combination thereof. As one example, the HVIL controller 630 may determine an expected return signal based on known resistance values and the output signal. When the HVIL controller 630 receives the return signal, the HVIL controller 630 may compare the received return signal to the expected return signal. In some configurations, the HVIL controller 630 may determine a status based on the comparison of the received return signal to the expected return signal. As one example, when the received return signal and the expected return signal match (e.g., are the same or are within an acceptable tolerance range), the HVIL controller 630 may determine a normal status. When the received return signal and the expected return signal do not match (e.g., are not the same or are outside of an acceptable tolerance range), the HVIL controller 630 may determine a fault status. In some configurations, the HVIL controller 630 may determine a source or cause of the fault status (e.g., where a disconnection has occurred), based on, e.g., resistance value(s), the output signal, the return signal, etc.

Accordingly, in some configurations, the HVIL controller 630 may determine a cause of the connection status (e.g., a fault status) with particularity to one or more actuators or connections of a plurality based on the return signal. For example, Table 1 below includes signal relationships for different conditions, where the output signal is 12V, the first resistor R1 has a resistance of 1K and the second resistor R2 has a resistance of 2K.

| Condition | Signal Relationship | Cause |
|---|---|---|
| All connected | Return Signal = Output Signal | n/a |
| Attachment-machine connection - open circuit (disconnected) | Return Signal = 0 V (ground) | Attachment-Machine Connection |
| First Electric Implement - open circuit<br>Second Electric Implement - closed circuit<br>(Total Resistance Applied to Output Signal = 1K) | Return Signal = ½ Output Signal (6 V) | First Electric Actuator or Implement Connection |
| First Electric Implement - closed circuit<br>Second Electric Implement - open circuit<br>(Total Resistance Applied to Output Signal = 2K) | Return Signal = ⅓ Output Signal (4 V) | Second Electric Actuator or Implement Connection |
| First Electric Implement - open circuit<br>Second Electric Implement - open circuit<br>(Total Resistance Applied to Output Signal = 3K) | Return Signal = ¼ Output Signal (2 V) | First Electric Actuator or Implement Connection and Second Electric Actuator or Implement Connection |

Again, although the configuration of FIG. 11 illustrates the attachment-machine connection 810 as a single interface between a power machine and a single attachment (with the two implement connections 1005), variations are possible. For example, a similar arrangement can be used with the electric implement connections (e.g., the first electric implement connection 1005A or the second electric implement connection 1005B) instead representing attachment-machine connections, such that the first and second output signals can be used to monitor the status of two separate implements with a single output signal.

While the discussion of FIG. 11 is with respect to implementation of one or more HVIL electric circuits 805 on an attachment (attachment-side), similarly one or more HVIL electric circuits 805 may be implemented on the power machine 605 (machine-side) or be integrated into the same one or more HVIL electric circuits 805 on the attachment. In one specific experimental embodiment, each electric actuator 645 on the power machine 605 or on an attachment coupled to the power machine 605 may each utilize an independent HVIL electric circuit. Accordingly, the HVIL controller 630 may communicate to the power machine controller 625 a fault code specific to a particular electric actuator circuit. In such a specific experimental embodiment, and, in response to a fault code that requires action, the controller circuitry of the power machine 605 (e.g., the control system 619, or the power machine controller 625 thereof) may isolate the effected electric circuit (e.g., by preventing or limiting power transmission through the effected electric circuit). As a result, a fault code in one or more HVIL electric circuits does not necessarily result in a power shut-down to the entire implement or power machine 605 thereby allowing some maintained functionality.

Figure 12:
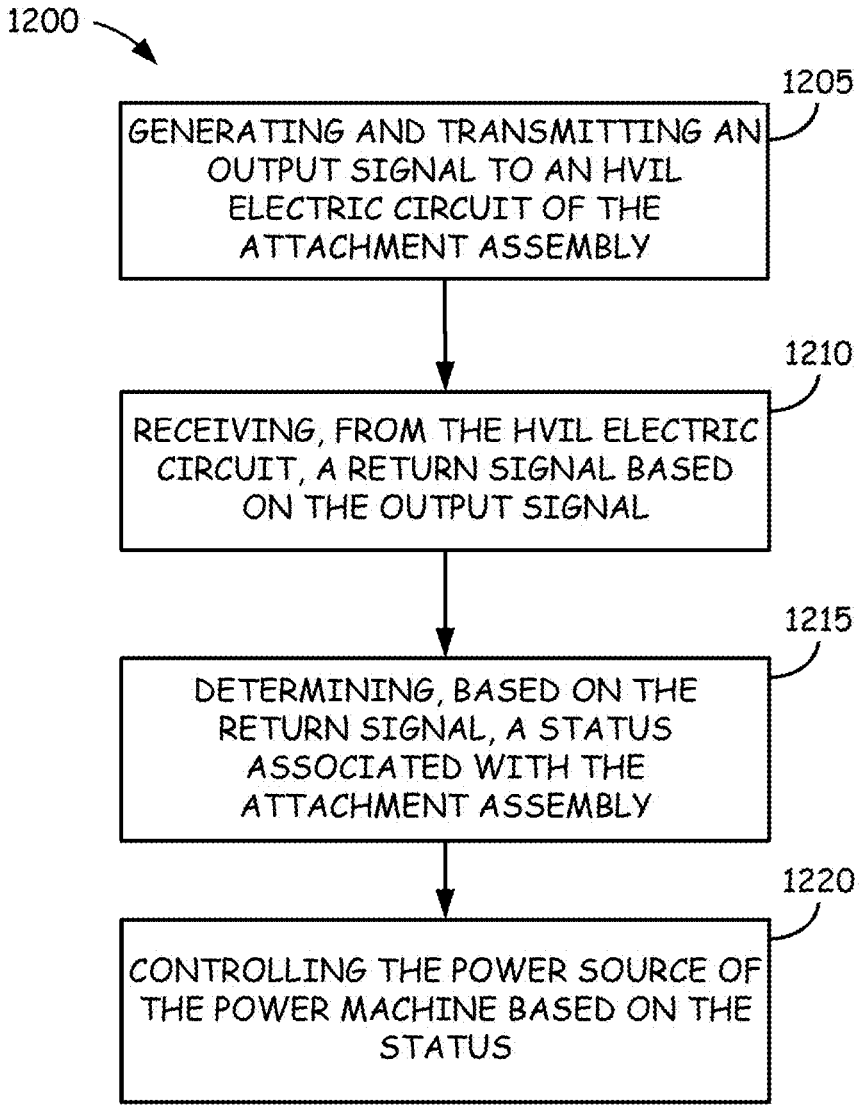
FIG. 12 is a flowchart illustrating a method providing power management and diagnostics for a power machine using the system of FIG. 6 according to some configurations.

FIG. 12 is a flowchart illustrating a method 1200 for providing power management and diagnostics for the power machine 605 according to some configurations. The method 1200 is described herein as being performed by the HVIL controller 630 (e.g., the electronic processor 700) and, in particular, the application 725 as executed by the electronic processor 700. However, as noted above, the functionality described with respect to the method 1200 may be performed by other devices, or distributed among a plurality of devices, such as, e.g., the HVIL controller 630, the power machine controller 625, etc.

As illustrated in FIG. 12, the method 1200 includes generating and transmitting, with the HVIL controller 630, an output signal to the HVIL electric circuit 805 of the attachment assembly 610 (at block 1205). The HVIL controller 630 may receive, from the HVIL electric circuit 805, a return signal based on the output signal (at block 1210). In response to receiving the return signal (at block 1210), the HVIL controller 630 may determine, based on the output signal, the return signal, or a combination thereof, a status associated with the attachment assembly 610 (at block 1215). The status may be a connection status associated with the attachment-machine connection 810, one or more electric implement connections (e.g., the first electric implement connection 1005A or the second electric implement connection 1005B), one or more electric actuators 645 (e.g., the first electric actuator 645A or the second electric actuator 645B), or a combination thereof. After determining the status, the HVIL controller 630 may control routing of power from the power source 620 of the power machine 605 to one or more implements based on the status (at block 1220).

In some examples, depending on the determined status, the HVIL controller 630 may transmit control signals (through the attachment-machine connection 810) to the power machine 605 for controlling the power source 620 (e.g., controlling the supply of power to the electric actuator (s) 645 from the power source 620). Alternatively, or in addition, the HVIL controller 630 may generate or maintain the diagnostic record(s) 735 (e.g., generate an error code for inclusion in the diagnostic record(s) 735), generate and transmit an alert to an operator of the power machine 605, control an operating mode of the power machine 605, etc.

In some configurations, in response to determining a fault status, the HVIL controller 630 may control routing of power from the power source 620 of the power machine 605 by disabling the power source 620 (i.e., implementing control so that no power can flow from the power source 620 to relevant systems). For example, the HVIL controller 630 may prevent power from being supplied from the power source 620 to the electric actuator 645 via the power-transmission electric circuit. Alternatively, or in addition, in some configurations, in response to determining a fault status, the HVIL controller 630 may execute a safe torque off function to ensure that no torque is applied at any relevant motor (e.g., as elaborated in the standard IEC 60204-1, as published by the International Electrotechnical Commission). Upon execution of the safe torque off function, the power machine 605 may enter a safe torque off mode. For instance, in response to determining a fault status, the HVIL controller 630 can control one or more motor drives or other components to ensure that no operable power is available at any relevant actuator (e.g., drive motor, lift actuator, etc.).

In some configurations, the HVIL controller 630 may determine a normal status when the output signal is the same or substantially similar to the return signal. In response to determining a normal status, the HVIL controller 630 may control the power source 620 of the power machine 605 by supplying power from the power source 620 to the electric actuator(s) 645 via the power-transmission electric circuit.

While various HVIL electric circuit embodiments are discussed herein with reference to their use in combination with the attachment assembly 610, one or more HVIL electric circuits may also be implemented within the power machine 605. For example, a HVIL electric circuit may be run in the same wiring loom or bundle as a power-transmission electric circuit that travels between the power source 620 and an electric actuator of the power machine 605 (e.g., workgroup actuators such as a tilt or lift actuator, or a tractive drive actuator). The tilt actuator, for example, is positioned on a distal end of a workgroup and the associated power-transmission electric circuit for the tilt actuator runs through various joints of the workgroup and may be exposed to an external environment proximal a work element. Each of these joints and the work element itself expose the power-transmission electric circuit to possible damage, wear, and a risk of the circuit to be severed entirely. By running the HVIL electric circuit in parallel with the power-transmission electric circuit on the various electric circuits on the power machine 605, similar to the various implement specific embodiment discussed in more detail above, similar benefits may be realized.

Unless otherwise specified or limited, the terms "about" and "approximately," as used herein with respect to a reference value, refer to variations from the reference value of ±15% or less, inclusive of the endpoints of the range. Similarly, the term "substantially," as used herein with respect to a reference value, refers to variations from the reference value of ±5% or less, inclusive of the endpoints of the range.

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of" For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

In some embodiments, aspects of the technology disclosed herein, including computerized implementations of methods according to the technology disclosed herein, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, embodiments of the technology disclosed herein can be implemented as a set of instructions, tangibly embodied on a non-transitory computer-readable media, such that a processor device can implement the instructions based upon reading the instructions from the computer-readable media. Some embodiments of the technology disclosed herein can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.). In some embodiments, a control device can include a centralized hub controller that receives, processes and (re)transmits control signals and other data to and from other distributed control devices (e.g., an engine controller, an implement controller, a drive controller, etc.), including as part of a hub-and-spoke architecture or otherwise.

The term "article of manufacture" as used herein is intended to encompass a computer program accessible from any computer-readable device, carrier (e.g., non-transitory signals), or media (e.g., non-transitory media). For example, computer-readable media can include but are not limited to magnetic storage devices (e.g., hard disk, floppy disk, magnetic strips, and so on), optical disks (e.g., compact disk (CD), digital versatile disk (DVD), and so on), smart cards, and flash memory devices (e.g., card, stick, and so on). Additionally, it should be appreciated that a carrier wave can be employed to carry computer-readable electronic data such as those used in transmitting and receiving electronic mail or in accessing a network such as the Internet or a local area network (LAN). Those skilled in the art will recognize that many modifications may be made to these configurations without departing from the scope or spirit of the claimed subject matter.

Certain operations of methods according to the technology disclosed herein, or of systems executing those methods, may be represented schematically in the FIGS. or otherwise discussed herein. Unless otherwise specified or limited, representation in the FIGS. of particular operations in particular spatial order may not necessarily require those operations to be executed in a particular sequence corresponding to the particular spatial order. Correspondingly, certain operations represented in the FIGS., or otherwise disclosed herein, can be executed in different orders than are expressly illustrated or described, as appropriate for particular embodiments of the technology disclosed herein. Further, in some embodiments, certain operations can be executed in parallel, including by dedicated parallel processing devices, or separate computing devices configured to interoperate as part of a large system.

As used herein in the context of computer implementation, unless otherwise specified or limited, the terms "component," "system," "module," "block," and the like are intended to encompass part or all of computer-related systems that include hardware, software, a combination of hardware and software, or software in execution. For example, a component may be, but is not limited to being, a processor device, a process being executed (or executable) by a processor device, an object, an executable, a thread of execution, a computer program, or a computer. By way of illustration, both an application running on a computer and the computer can be a component. One or more components (or system, module, and so on) may reside within a process or thread of execution, may be localized on one computer, may be distributed between two or more computers or other processor devices, or may be included within another component (or system, module, and so on).

Although the technology disclosed herein has been described with reference to preferred embodiments, workers skilled in the art will recognize that changes may be made in form and detail to the disclosed embodiments without departing from the spirit and scope of the concepts discussed herein.

What is claimed is:

1. A system, comprising:

one or more electronic processors configured to generate and transmit an output signal to a first electric circuit of an electrically powered implement removably coupled to a power machine, wherein the electrically powered implement includes a first electric actuator and a second electric actuator, wherein the output signal is transmitted to the first electric circuit via a connector assembly of the power machine, wherein the first electric actuator is coupled to the first electric circuit via a first attachment connector and the second electric actuator is coupled to the first electric circuit via a second attachment connector, and wherein the first electric actuator and the second electric actuator are configured to perform work operations using power from an electrical power source of the power machine received via the connector assembly;

receive, via the connector assembly, a return signal from the first electric circuit, the return signal being provided by the first electric circuit in response to the output signal;

determine, based on the return signal, a status related to the electrically powered implement;

in response to determining that the status is a fault status, determine a source of the fault status based on the return signal, wherein the source of the fault status is related to at least one of the first attachment connector, the second attachment connector, the first electric actuator, or the second electric actuator; and control routing of power from the electrical power source of the power machine to the first electric actuator or the second electric actuator via the connector assembly, based on the status.

2. The system of claim 1, wherein the one or more electronic processors are further configured to control the routing of power from the electrical power source of the power machine to the first electric actuator or the second electric actuator of the power machine along a second electric circuit of the power machine via the connector assembly; and wherein the second electric circuit of the power machine is arranged in parallel with the first electric circuit of the first electric actuator and the second electric actuator.

3. The system of claim 1, wherein the one or more electronic processors are configured to control the routing of power from the electrical power source to a third electric circuit of the first electric actuator or the second electric actuator via the connector assembly;

wherein the first electric circuit is an interlock loop arranged in parallel with the third electric circuit; and wherein the output signal is a low voltage signal having a lower voltage than the power routed from the electrical power source to the third electric circuit.

4. The system of claim 1, wherein the first electric actuator includes at least one of an auger, a sweeper, a mulcher, a chipper, a breaker, a grapple, or a saw operable by an electric motor that is powered by the electrical power source of the power machine.

5. The system of claim 1, wherein the one or more electronic processors are configured to determine the status by comparing the output signal to the return signal; and wherein the one or more electronic processors are configured to:

determine the fault status as the status when the output signal is different from the return signal; or determine a normal status as the status when the output signal is the same as the return signal.

6. The system of claim 1, wherein, in response to determining the fault status as the status, the one or more electronic processors are configured to control the routing of power from the electrical power source of the power machine via the connector assembly by preventing power from being supplied from the electrical power source to at least one of the first electric actuator or the second electric actuator.

7. The system of claim 6, wherein the at least one of the first electric actuator or the second electric actuator is configured to receive, via the connector assembly, power from the electrical power source via a second electric circuit of the first electric actuator or the second electric actuator that is arranged in parallel with the first electric circuit.

8. The system of claim 6, wherein, in response to determining the fault status as the status, the one or more electronic processors are configured to control the routing of power to at least one of the first electric actuator or the second electric actuator via the connector assembly by disabling the electrical power source.

9. The system of claim 8, wherein the one or more electronic processors are configured to disable the electrical power source in response to determining the fault status as the status by executing a safe torque off function for the power machine and at least one of the first electric actuator and the second electric actuator.

10. A power machine comprising:

a frame;

an electrical power source supported by the frame;

an attachment assembly supported by the frame, the attachment assembly including:

a connector assembly electrically coupling the attachment assembly to the power machine;

a first electrically powered implement removably supported by the frame, the first electrically powered implement configured to perform work operations using power from the electrical power source received via the connector assembly;

a second electrically powered implement removably supported by the frame and configured to perform work operations using power from the electrical power source received via the connector assembly; and an electric network including:

a first electric circuit configured to receive and route an output signal, wherein the first electrically powered implement is connected to the first electric circuit via the first attachment connector and the second electrically powered implement is connected to the first electric circuit via the second attachment connector; and a second electric circuit configured to receive power from the electrical power source to power a first electric actuator of the first electrically powered implement and a second electric actuator of the second electrically powered implement; and a control system electrically coupled to the attachment assembly via the connector assembly, the control system including one or more electronic processors configured to:

generate and provide the output signal to the first electric circuit via the connector assembly;

receive a return signal from the first electric circuit via the connector assembly, the return signal corresponding to transmission of the output signal through the first electric circuit;

determine, based on the return signal, a first status for the attachment assembly; and control routing of power from the electrical power source to the second electric circuit via the connector assembly, based on the first status.

11. The power machine of claim 10, wherein the electric network includes a first resistor positioned in parallel with the first attachment connector and a second resistor positioned in parallel with the second attachment connector, wherein the return signal is provided by the first electric circuit based on whether electric current flows through at least one of the first resistor or the second resistor.

12. The power machine of claim 10, wherein the one or more electronic processors are configured to determine the first status for the attachment assembly by determining a status for the first electrically powered implement based on the return signal; and determining a status for the second electrically powered implement based on the return signal.

13. The power machine of claim 10, wherein, in response to determining a fault status, the one or more electronic processors are further configured to determine a source of the fault status based on the return signal.

14. The power machine of claim 13, wherein the source of the fault status includes at least one of the connector assembly, the first electrically powered implement, or the second electrically powered implement.

15. The power machine of claim 13, wherein the source of the fault status is the connector assembly.

16. The power machine of claim 13, wherein the source of the fault status is the first electrically powered implement.

* * * * *